US011072167B2

(12) United States Patent
Tanaka

(10) Patent No.: US 11,072,167 B2
(45) Date of Patent: Jul. 27, 2021

(54) DATA TRANSFER APPARATUS, RECORDING HEAD, AND DATA TRANSFER METHOD

(71) Applicant: CANON KABUSHIKI KAISHA, Tokyo (JP)

(72) Inventor: Souhei Tanaka, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/817,355

(22) Filed: Mar. 12, 2020

(65) Prior Publication Data

US 2020/0298560 A1 Sep. 24, 2020

(30) Foreign Application Priority Data

Mar. 22, 2019 (JP) ..... JP2019-054533

(51) Int. Cl.
*B41J 2/045* (2006.01)

(52) U.S. Cl.
CPC ..... *B41J 2/04573* (2013.01); *B41J 2/04541* (2013.01); *B41J 2/04586* (2013.01)

(58) Field of Classification Search
CPC . B41J 2/04573; B41J 2/04541; B41J 2/04586
See application file for complete search history.

(56) References Cited

U.S. PATENT DOCUMENTS 9,776,434 B2 * 10/2017 Saikawa ..... G06K 15/18

FOREIGN PATENT DOCUMENTS

JP 2000-25228 A 1/2000

* cited by examiner

*Primary Examiner* — Thinh H Nguyen
(74) *Attorney, Agent, or Firm* — Canon U.S.A., Inc. IP Division

(57) ABSTRACT

An apparatus that transfers data to a recording head having a plurality of recording elements includes a transfer unit for transferring recording data to which a series of commands is attached in synchronization with a clock. The series of commands includes a stop command for temporarily stopping transfer of the recording data for a predetermined period in accordance with power-distribution timing of the recording elements.

20 Claims, 17 Drawing Sheets

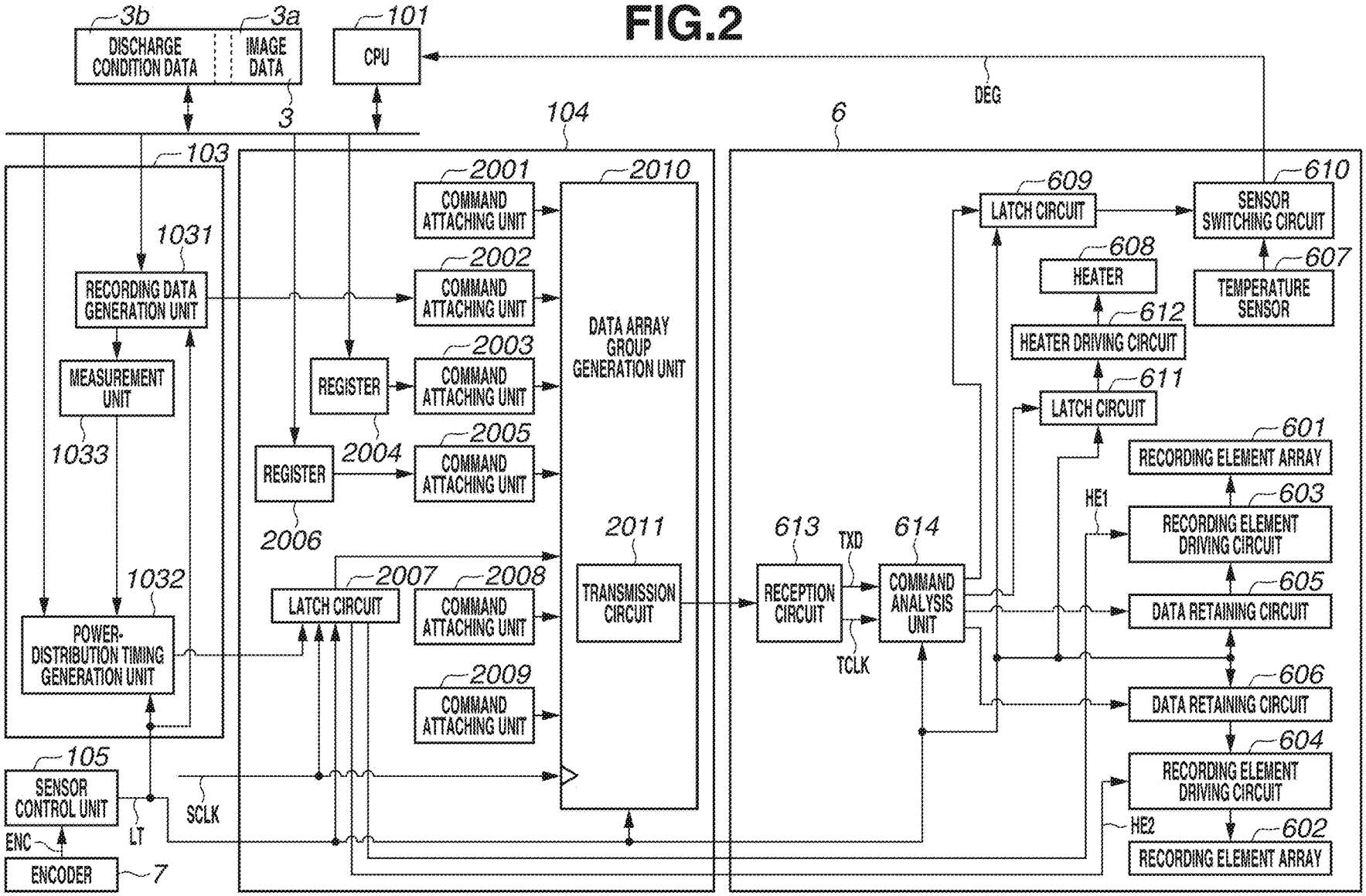
FIG.2
6
610
SENSOR SWITCHING CIRCUIT
607
TEMPERATURE SENSOR
601
RECORDING ELEMENT ARRAY
603
RECORDING ELEMENT DRIVING CIRCUIT
605
DATA RETAINING CIRCUIT
606
DATA RETAINING CIRCUIT
604
RECORDING ELEMENT DRIVING CIRCUIT
602
RECORDING ELEMENT ARRAY
612
HEATER DRIVING CIRCUIT
611
LATCH CIRCUIT
608
HEATER
609
LATCH CIRCUIT
HE1
HE2
DEG
614
COMMAND ANALYSIS UNIT
TXD
TCLK
613
RECEPTION CIRCUIT
104
2010
DATA ARRAY GROUP GENERATION UNIT
2011
TRANSMISSION CIRCUIT
2001
COMMAND ATTACHING UNIT
2002
COMMAND ATTACHING UNIT
2003
COMMAND ATTACHING UNIT
2005
COMMAND ATTACHING UNIT
2008
COMMAND ATTACHING UNIT
2009
COMMAND ATTACHING UNIT
101
CPU
REGISTER
2004
REGISTER
2006
2007
LATCH CIRCUIT
3a
IMAGE DATA
3
3b
DISCHARGE CONDITION DATA
103
1031
RECORDING DATA GENERATION UNIT
MEASUREMENT UNIT
1033
1032
POWER-DISTRIBUTION TIMING GENERATION UNIT
SCLK
LT
105
SENSOR CONTROL UNIT
ENC
ENCODER
7

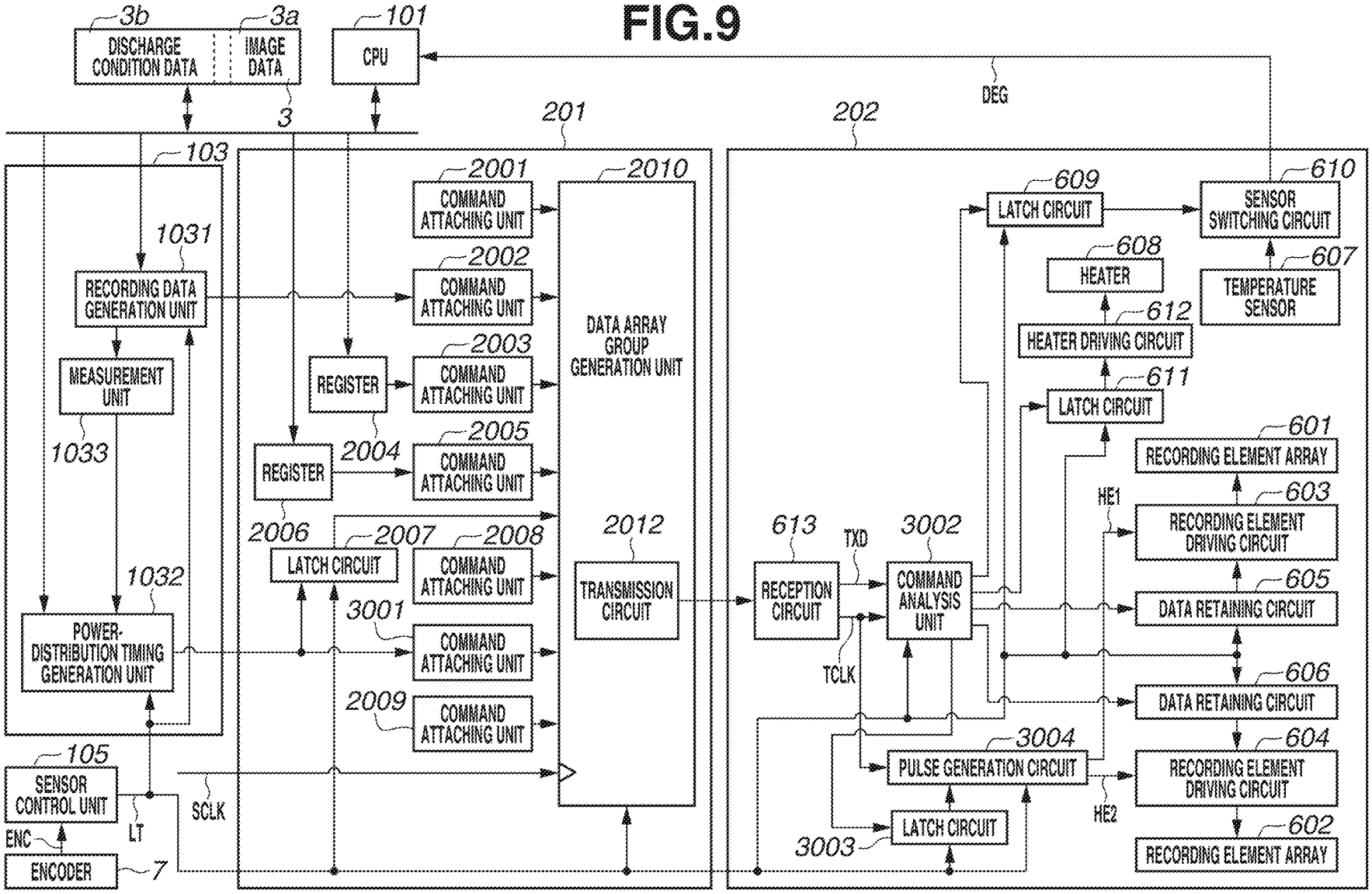
FIG.9
202
201
103
105
101
CPU
3a
IMAGE DATA
3
3b
DISCHARGE CONDITION DATA
610
SENSOR SWITCHING CIRCUIT
607
TEMPERATURE SENSOR
601
RECORDING ELEMENT ARRAY
603
RECORDING ELEMENT DRIVING CIRCUIT
605
DATA RETAINING CIRCUIT
606
DATA RETAINING CIRCUIT
604
RECORDING ELEMENT DRIVING CIRCUIT
602
RECORDING ELEMENT ARRAY
608
HEATER
612
HEATER DRIVING CIRCUIT
611
LATCH CIRCUIT
609
LATCH CIRCUIT
HE1
HE2
3004
PULSE GENERATION CIRCUIT
LATCH CIRCUIT
3003
3002
COMMAND ANALYSIS UNIT
TXD
TCLK
613
RECEPTION CIRCUIT
DEG
2010
DATA ARRAY GROUP GENERATION UNIT
2012
TRANSMISSION CIRCUIT
2001
COMMAND ATTACHING UNIT
2002
COMMAND ATTACHING UNIT
2003
COMMAND ATTACHING UNIT
2005
COMMAND ATTACHING UNIT
2008
COMMAND ATTACHING UNIT
COMMAND ATTACHING UNIT
COMMAND ATTACHING UNIT
REGISTER
2004
REGISTER
2006
2007
LATCH CIRCUIT
3001
2009
1031
RECORDING DATA GENERATION UNIT
MEASUREMENT UNIT
1033
1032
POWER-DISTRIBUTION TIMING GENERATION UNIT
SCLK
LT
SENSOR CONTROL UNIT
ENC
ENCODER
7

DATA TRANSFER APPARATUS, RECORDING HEAD, AND DATA TRANSFER METHOD

BACKGROUND OF THE INVENTION

Field of the Invention

The aspect of the embodiments relates to a data transfer apparatus that transfers data to a recording head having a plurality of recording elements.

Description of the Related Art

A recording apparatus discussed in Japanese Patent Application Laid-Open No. 2000-25228 includes a recording head having a plurality of recording elements and a driving control circuit for driving the recording head. The driving control circuit transfers a heat pulse, a clock, and recording data to the recording head. The heat pulse represents a power-distribution timing of the recording element, and is also called as a heat enable signal. The recording data is transferred to the recording head in synchronization with a clock. The clock used for transferring the recording data is called as a data transfer clock.

Generally, crosstalk noise is generated when the heat pulse rises and falls. There is a case where the recording head cannot acquire accurate recording data because of an influence of the crosstalk noise on the data transfer clock or the recording data. For example, if a waveform of a rising portion or a falling portion of the data transfer clock is disturbed because of the influence of the crosstalk noise, the recording head cannot latch the recording data accurately.

The recording apparatus discussed in Japanese Patent Application Laid-Open No. 2000-25228 reduces an influence of crosstalk noise by temporarily stopping the data transfer clock at rising and falling timings of the heat pulse.

However, in the recording apparatus discussed in Japanese Patent Application Laid-Open No. 2000-25228, an influence of crosstalk noise on recording data is not taken into consideration. Therefore, there has been a need for countermeasures against the influence of crosstalk noise on the recording data.

Further, there is a case where the data transfer clock is also used for an operation clock of a circuit in the recording head. In this case, the circuit in the recording head may not operate normally if the data transfer clock is stopped. Therefore, there has been a need for a technique of reducing the influence of crosstalk noise without stopping the data transfer clock.

SUMMARY OF THE INVENTION

According to an aspect of the embodiments, an apparatus includes a first acquisition unit configured to acquire recording data for executing recording on a recording medium, a transfer unit configured to attach a series of commands to the acquired recording data and transfer the recording data to which the series of commands is attached to a recording head having a plurality of recording elements for executing recording on a recording medium in synchronization with a clock, and a second acquisition unit configured to acquire power-distribution timing to the plurality of recording elements, wherein the series of commands includes a stop command for temporarily stopping transfer of the recording data for a predetermined period corresponding to the power-distribution timing, which is generated based on the acquired power-distribution timing.

Further features of the disclosure will become apparent from the following description of exemplary embodiments with reference to the attached drawings.

BRIEF DESCRIPTION OF THE DRAWINGS

FIG. 2 is a block diagram illustrating a configuration of a portion relating to data transfer of the image recording apparatus in FIG. 1.

FIG. 9 is a block diagram illustrating a configuration of a portion relating to data transfer of an image recording apparatus according to a third exemplary embodiment of the disclosure.

DESCRIPTION OF THE EMBODIMENTS

Exemplary embodiments according to the disclosure will be described with reference to the appended drawings.

Figure 1:
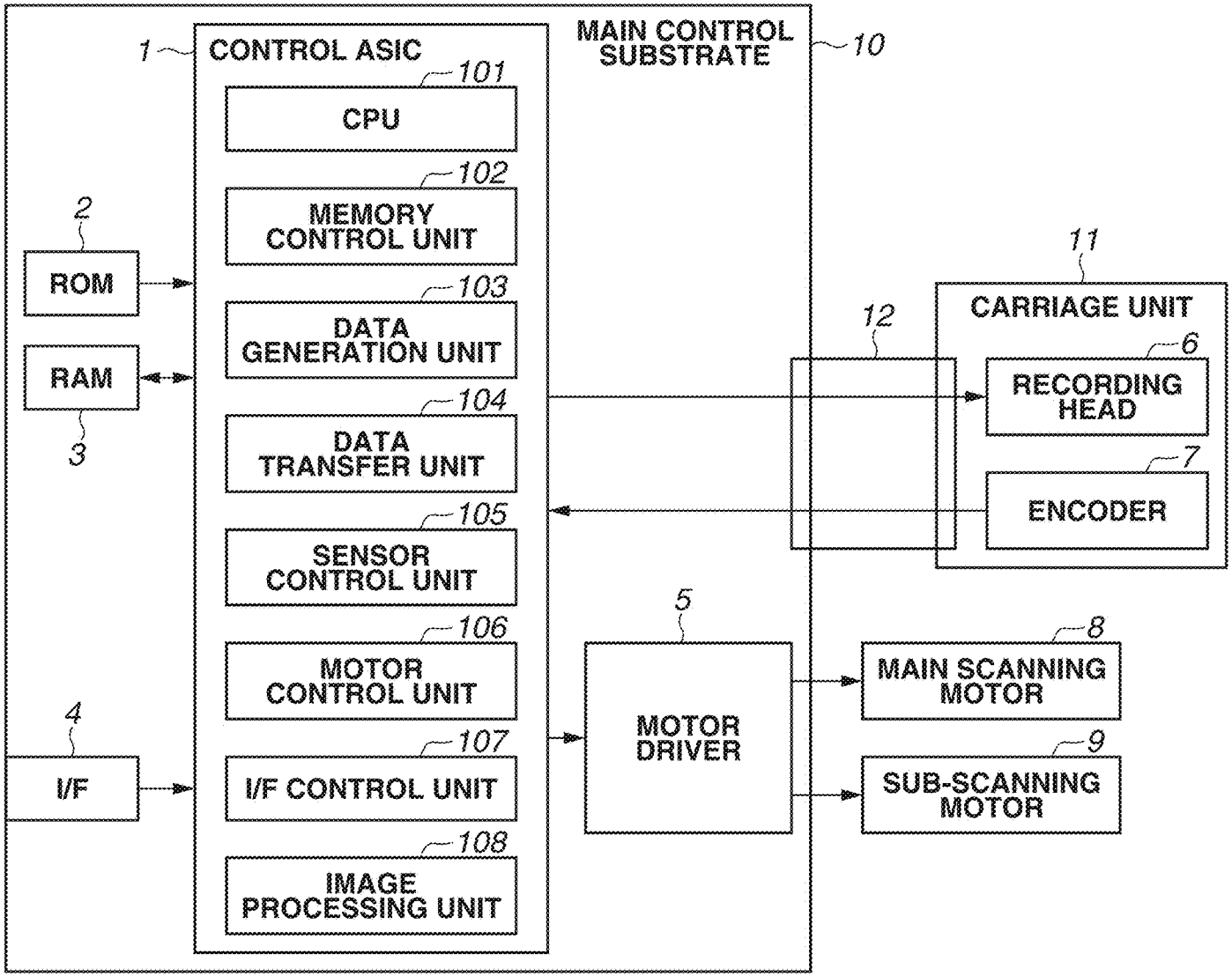
FIG. 1 is a block diagram schematically illustrating a configuration of an image recording apparatus according to a first exemplary embodiment of the disclosure.

FIG. 1 is a block diagram schematically illustrating a configuration of an image recording apparatus according to a first exemplary embodiment of the disclosure.

The image recording apparatus of the present exemplary embodiment is an ink-jet type recording apparatus, which executes recording on a recording medium such as a sheet or a fabric. As illustrated in FIG. 1, the image recording apparatus of the present exemplary embodiment includes a main control substrate 10, a carriage unit 11 electrically connected to the main control substrate 10 via a transfer path 12, a main scanning motor 8, and a sub-scanning motor 9. For example, the transfer path 12 is a flexible flat cable (FFC). The main scanning motor 8 reciprocally moves the carriage unit 11. The sub-scanning motor 9 moves a recording medium. A moving direction of the carriage unit 11 is a main scanning direction, and a moving direction of a recording medium is a sub-scanning direction.

The carriage unit 11 includes a recording head 6 and an encoder 7. The recording head 6 includes a plurality of recording elements. A plurality of the recording elements may constitute a plurality of recording element arrays. For example, each of the recording elements is a heat generating resistive element (also called as an electrothermal conversion element) that causes a liquid to be discharged from a discharge port. The heat generating resistive element converts electric energy to thermal energy and applies the thermal energy to the liquid. In the recording element array, each of the recording elements is connected to a power-supply line in parallel, so that a driving current can be selectively supplied to each of the recording elements. In the present exemplary embodiment, applying a driving current to the recording element is called "power-distribution".

The encoder 7 outputs an encoder signal representing a moving direction and a moving amount of the carriage unit 11. For example, the encoder 7 includes a sensor that changes a signal every time the carriage unit 11 is moved by a certain distance (e.g., 1/600 inches).

The main control substrate 10 includes a control Application Specific Integrated Circuit (ASIC) 1, a Read Only Memory (ROM) 2, a Random Access Memory (RAM) 3, an interface (I/F) 4, and a motor driver 5. The motor driver 5 drives the main scanning motor 8 and the sub-scanning motor 9. The control ASIC 1 is electrically connected to each of the ROM 2, the RAM 3, the OF 4 and the motor driver 5. The control ASIC 1 is electrically connected to the recording head 6 and the encoder 7 via the transfer path 12. The control ASIC 1 includes a Central Processing Unit (CPU) 101, a memory control unit 102, a data generation unit 103, a data transfer unit 104, a sensor control unit 105, a motor control unit 106, an OF control unit 107, and an image processing unit 108. The control ASIC 1 can be called as a data transfer apparatus.

The ROM 2 stores a program to be executed by the CPU 101 and fixed data necessary for various operations of the image recording apparatus. The RAM 3 is used as a work area of the CPU 101 or a temporary storage area of various types of received data. For example, image data and discharge condition data are stored in the RAM 3.

Various types of setting data can also be stored in the RAM 3.

The CPU 101 is responsible for controlling the entire image recording apparatus. The CPU 101 uses the RAM 3 as a work area to execute various control programs stored in the ROM 2, and outputs a control command for controlling various operations in the image recording apparatus. For example, the CPU 101 creates discharge condition data on the RAM 3 based on temperature information for the recording head 6.

Each of the memory control unit 102, the data generation unit 103, the data transfer unit 104, the sensor control unit 105, the motor control unit 106, and the OF control unit 107 executes various operation controls in the image recording apparatus in cooperation with the CPU 101. The memory control unit 102 executes memory control for allowing the CPU 101 and various control units to access the ROM 2 or the RAM 3. The OF control unit 107 executes protocol control for communicating with an external computer apparatus, and receives recording data and a recording command from the external computer apparatus to store the received data in the RAM 3.

The image processing unit 108 operates based on an instruction from the CPU 101, converts recording data stored in the RAM 3 into image data, and stores the image data in the RAM 3. Based on the image data or the discharge condition data in the RAM 3, the data generation unit 103 generates data for discharging a liquid from the recording head 6 and power-distribution timing data for executing discharge processing. Ink is an example of the liquid. The data for discharging liquid constitutes recording data to be transferred to the recording head 6.

The data transfer unit 104 transfers recording data to which a series of commands is attached in synchronization with a clock (hereinafter, also called as "data transfer clock"). Specifically, the data transfer unit 104 attaches a series of commands to the recording data generated by the data generation unit 103, and serially transfers the recording data to which the series of commands is attached via the transfer path 12 in synchronization with the data transfer clock. Further, the data transfer unit 104 supplies, to the recording head 6, power-distribution timing data generated by the data generation unit 103 and heat enable signals HE1 and HE2 generated by using that power-distribution timing data. The recording data to which the series of commands is attached, the power-distribution timing data, and the heat enable signals HE1 and HE2 are supplied to the recording head 6 each time the carriage unit 11 is moved by a predetermined distance.

The sensor control unit 105 executes processing on a sensor signal such as an encoder signal output from the encoder 7. For example, based on an encoder signal ENC output from the encoder 7, the sensor control unit 105 calculates a position, a moving speed, and a moving direction of the carriage unit 11. Further, based on the position information of the carriage unit 11, the sensor control unit 105 generates a latch signal LT representing a discharge timing of liquid. The sensor control unit 105 supplies the latch signal LT to the data generation unit 103 and the data transfer unit 104. The latch signal LT is also supplied to the recording head 6 via the data transfer unit 104.

The motor control unit 106 controls the operation of the motor driver 5 following a control instruction from the CPU 101. For example, the motor control unit 106 drives the main scanning motor 8 via the motor driver 5 to control a speed and a position of the carriage unit 11 reciprocally moving in the main scanning direction. Further, the motor control unit 106 drives the sub-scanning motor 9 via the motor driver 5 to control the movement of the recording medium in the sub-scanning direction.

Next, a configuration of a portion relating to data transfer with respect to the recording head 6, which is a feature of the image recording apparatus of the present exemplary embodiment, will be described in detail.

FIG. 2 is a block diagram illustrating a detailed configuration of a portion relating to data transfer of the image recording apparatus illustrated in FIG. 1. The recording head 6 in FIG. 2 is configured of an element substrate with a semiconductor chip mounted and a liquid flow path forming member. Recording element arrays 601 and 602, recording element driving circuits 603 and 604, and recording data retaining circuits 605 and 606 are arranged on the element substrate. Each of the recording element arrays 601 and 602 is configured of a plurality of recording elements arranged in a row. In each of the recording element arrays 601 and 602, the recording elements are connected to a power-supply line in parallel and can be driven selectively. The number of recording element arrays may be three or more.

Of the heat enable signals HE1 and HE2 generated by the data transfer unit 104, the heat enable signal HE1 is supplied to the recording element driving circuit 603, and the heat enable signal HE2 is supplied to the recording element driving circuit 604. The recording element driving circuit 603 applies voltage to the recording element array 601 based on the heat enable signal HE1 and the recording data retained in the recording data retaining circuit 605. The recording element driving circuit 604 applies voltage to the recording element array 602 based on the heat enable signal HE2 and the recording data retained in the recording data retaining circuit 606.

A temperature sensor 607, a heater 608, a latch circuit 609 for selecting a sensor, a sensor switching circuit 610, a latch circuit 611 for controlling a heater, a heater driving circuit 612, a reception circuit 613, and a command analysis unit 614 are further arranged on the element substrate. A latch signal LT output from the sensor control unit 105 is supplied to the latch circuits 609 and 611, the command analysis unit 614, and the recording data retaining circuits 605 and 606.

The reception circuit 613 receives the recording data, to which a series of commands is attached, which is serially transferred by the data transfer unit 104 in synchronization with the transfer clock. The reception circuit 613 supplies, to the command analysis unit 614, a clock TCLK based on the data transfer clock and data TXD based on the recording data to which the series of commands is attached. The command analysis unit 614 analyzes the series of commands included in the data TXD based on the clock TCLK. The command analysis unit 614 supplies data to the latch circuits 609 and 611 and the recording data retaining circuits 605 and 606 based on a result of command analysis. If the series of commands includes a stop command for temporarily stopping transfer of data for a predetermined period in accordance with the power-distribution timing of the recording element, the command analysis unit 614 stops the processing for retaining data in the recording data retaining circuits 605 and 606 for a predetermined period.

The temperature sensor 607 detects temperature of the semiconductor chip. The heater 608 heats the semiconductor chip. In order to stably discharge liquid, in one embodiment, the entire semiconductor chip is uniformly maintained at an appropriate temperature. Therefore, a plurality of temperature sensors 607 and heaters 608 are arranged on the semiconductor chip. In the present exemplary embodiment, three temperature sensors 607 and three heaters 608 are arranged on each of the recording element arrays 601 and 602, so that each of the recording element arrays 601 and 602 is divided into three portions. The temperature sensors 607 and the heaters 608 have one-to-one correspondence.

Further, as illustrated in FIG. 2, the data generation unit 103 includes a recording data generation unit 1031, a power-distribution timing generation unit 1032, and a measurement unit 1033. A latch signal LT output from the sensor control unit 105 is supplied to the recording data generation unit 1031 and the power-distribution timing generation unit 1032.

Each time the latch signal LT is changed once, the recording data generation unit 1031 generates image data corresponding to a block of recording elements in each of the recording element arrays from image data 3*a* taken from the RAM 3. The recording data generation unit 1031 transmits, to the data transfer unit 104, recording data including a block number and image data for each recording element. The image data generated by the recording data generation unit 1031 is also supplied to the measurement unit 1033. In the present exemplary embodiment, the number of blocks per one recording element array and the number of recording elements constituting the block can be set as appropriate.

The measurement unit 1033 measures the number of recording elements for discharging liquid (i.e., number of discharges) based on the image data received from the recording data generation unit 1031. The measurement unit 1033 supplies a measurement value of the number of discharges to the power-distribution timing generation unit 1032. Based on a discharge condition data 3*b* taken from the RAM 3 and the measurement value of the number of discharges supplied from the measurement unit 1033, the power-distribution timing generation unit 1032 generates timing data for starting and ending power-distribution of the recording elements. At this time, the power-distribution timing generation unit 1032 generates a power-distribution start timing PT11 and a power-distribution end timing PT12 of the recording elements in the recording element array 601 and a power-distribution start timing PT21 and a power-distribution end timing PT22 of the recording elements in the recording element array 602. The power-distribution timing generation unit 1032 transmits power-distribution timing data including the timings PT11, PT12, PT21, and PT22 to the data transfer unit 104. In the present exemplary embodiment, timings PT11, PT12, PT21, and PT22 are also referred to as timing data PT11, PT12, PT21, and PT22.

The data transfer unit 104 includes command attaching units 2001 to 2003, 2005, 2008, and 2009, a register 2004 for selecting a sensor, a register 2006 for controlling a heater, a latch circuit 2007 for the power-distribution timing, and a data array group generation unit 2010.

The register 2004 retains data of a sensor to be selected. The CPU 101 writes data representing any one of the temperature sensors within the recording head 6 in the register 2004. The register 2006 retains data about a heater to be selected. The CPU 101 writes data representing any one of the heaters within the recording head 6 in the register 2006.

The command attaching unit 2001 attaches a start command including a start command code representing start of data transfer. The command attaching unit 2002 attaches a transfer command including a transfer command code on top of the recording data of each of the recording elements supplied from the recording data generation unit 1031. For example, a transfer command is attached on top of the recording data of each of the recording element arrays 601 and 602. When the CPU 101 writes data into the register 2004, the command attaching unit 2003 attaches a sensor selection command including a sensor selection command code on top of that data. When the CPU 101 writes data into the register 2006, the command attaching unit 2005 attaches a heater selection command including a heater selection command code on top of that data.

The latch circuit 2007 latches the power-distribution timing data PT11, PT12, PT21, and PT22 supplied from the power-distribution timing generation unit 1032 again at a rising timing of the latch signal LT. The latch circuit 2007 includes an internal counter operated by the system clock SCLK. The latch circuit 2007 generates the heat enable signals HE1 and HE2 for discharging liquid based on the image data transferred at a timing of latching one time before.

The command attaching unit 2008 attaches a stop command for temporarily stopping transfer of the recording data in accordance with the rising timing and the falling timing of each of the heat enable signals HE1 and HE2. The rising and falling timings of the heat enable signal HE1 respectively correspond to the power-distribution timing data PT11 and PT12 latched by the latch circuit 2007. The rising and falling timings of the heat enable signal HE2 respectively correspond to the power-distribution timing data PT21 and PT22 latched by the latch circuit 2007. The stop command may include a momentary stop code representing that data transfer is brought into a stopped state temporarily, data specifying a predetermined period, and dummy data transferred in the predetermined period.

The command attaching unit 2009 attaches an error detection command including a command code to be transmitted at the end of a series of commands. The recording head 6 operates erroneously because of data corruption occurring in the transferred data. In order to minimize a failure caused by the erroneous operation, the command attaching unit 2009 includes a cyclic redundancy check (CRC) arithmetic circuit for executing CRC calculation on a series of transferred data. The error detection command includes a CRC checking command code accompanied by data of a CRC calculation result. The CRC arithmetic circuit executes calculation using the following formula (formula (1)).

$$\text{“}X^8+X^2+X+1\text{”} \quad (1)$$

In addition, the CRC arithmetic circuit may execute calculation using another polynomial expression.

The data array group generation unit 2010 includes a transmission circuit 2011 having a first-in-first-out (FIFO) memory. The data array group generation unit 2010 transmits commands and data respectively output from the command attaching units 2001 to 2003, 2005, 2008, and 2009 to the FIFO memory of the transmission circuit 2011. Order of transmitting the commands and data to the FIFO memory is determined based on the power-distribution start timing data PT11 and PT21 and the power-distribution end timing data PT12 and PT22 output from the latch circuit 2007. The transmission circuit 2011 transmits the recording data to which the series of commands is attached, which is stored in the FIFO memory, to the reception circuit 613 of the recording head 6.

Next, transfer operation of the recording data to which the series of commands is attached will be described in detail.

Figure 3:
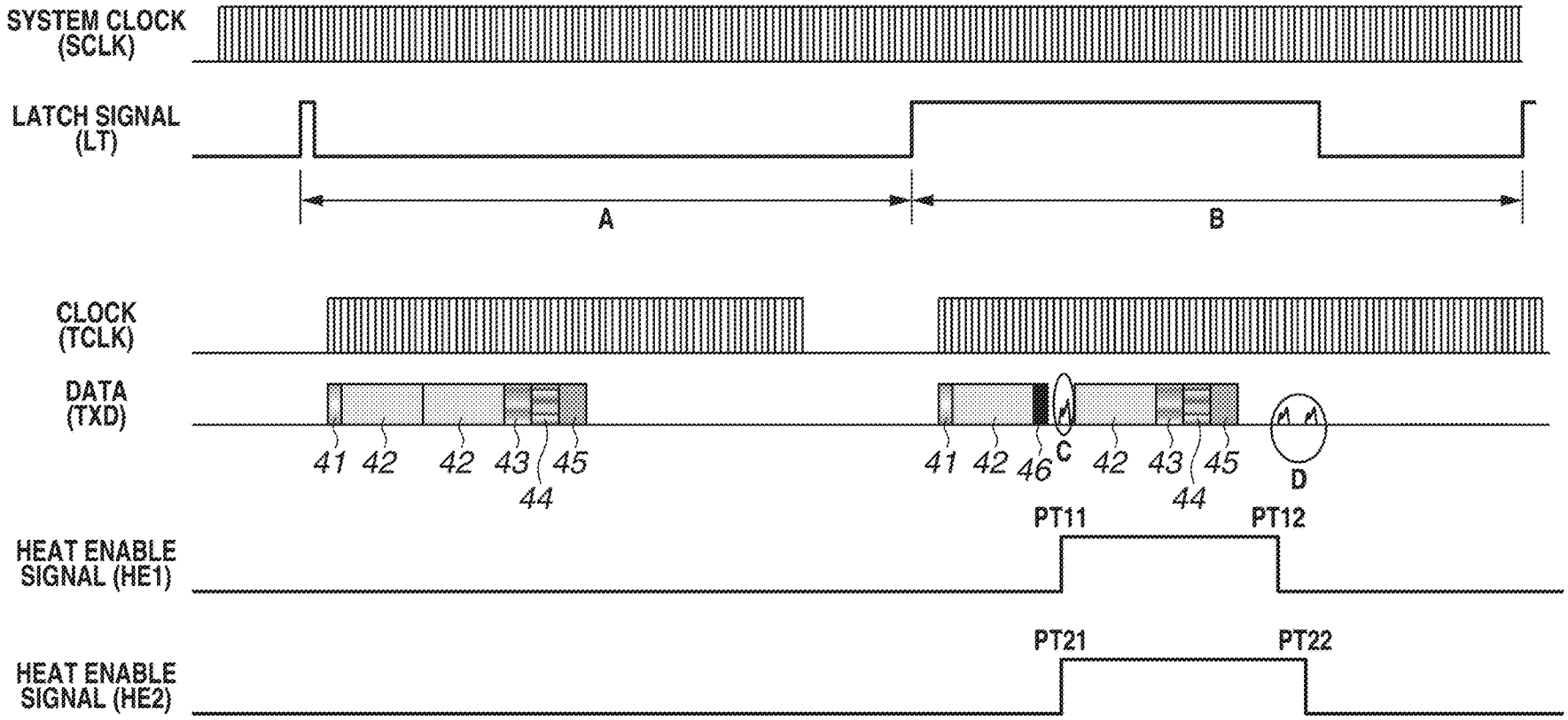
FIG. 3 is a timing chart illustrating a relationship between a command and a heat enable signal of the image recording apparatus in FIG. 1.

FIG. 3 is a timing chart illustrating data transfer operation of the recording data to which the series of commands is attached, performed by the data transfer unit 104. In FIG. 3, the system clock SCLK, the latch signal LT, the clock TCLK, the data TXD, and the heat enable signals HE1 and HE2 are illustrated in this order from the top.

The system clock SCLK is used for operating the latch circuit 2007 and the data array group generation unit 2010, and also used for operating a counter circuit and a sequencer circuit arranged in the data transfer unit 104. The latch signal LT is a signal generated based on an encoder signal ENC, and is used for determining a transfer timing and a discharge timing. In the example illustrated in FIG. 3, the latch signal LT includes a section A and a section B. In the section A, only data transfer is executed. In the section B, liquid is discharged based on the data transferred in the section A while executing subsequent data transfer. In the section B in which discharge of liquid is executed, the latch signal LT is at a high level during a period longer than at a low level.

A command is transferred by using the clock TCLK and the data TXD. The heat enable signal HE1 is a signal for turning on the recording elements of the recording element array 601. The heat enable signal HE2 is a signal for turning on the recording elements of the recording element array 602.

Because the rising timing PT21 of the heat enable signal HE1 overlaps with the rising timing PT22 of the heat enable signal HE2, driving current flows in the recording element arrays 601 and 602 simultaneously. In this case, a large crosstalk noise is superimposed on the data TXD signal in a section C. On the other hand, because the falling timing PT12 of the heat enable signal HE1 does not overlap with the falling timing PT22 of the heat enable signal HE2, driving current does not flow in the recording element arrays 601 and 602 simultaneously. In this case, although the crosstalk noise is superimposed on the data TXD signal in a section D, the crosstalk noise is small when compared to the section C.

In the section A, the data TXD signal to which the series of commands is attached is serially transferred in synchronization with the clock TCLK. A start command 41 of data transfer, an image data transfer command 42 for each of the recording element arrays 601 and 602, a sensor switching command 43, a heater control command 44, and an error detection command 45 are transferred in this order as the series of commands. In the section B, when the data TXD signal to which the series of commands is attached is serially transferred in synchronization with the clock TCLK, a stop command 46 is included in the series of commands. In this case, after the start command 41 and the image data transfer command 42 for the recording element array 601 are transferred, the stop command 46 is transferred in order to avoid the noise generated in the section C. When a predetermined time has passed after the stop command 46 is transferred, the image data transfer command 42 for the recording element array 602, the sensor switching command 43, the heater control command 44, and the error detection command 45 are transferred in this order.

Next, a processing procedure for avoiding the crosstalk noise and transferring the recording data to which the series of commands is attached will be described in detail.

Figure 4A:
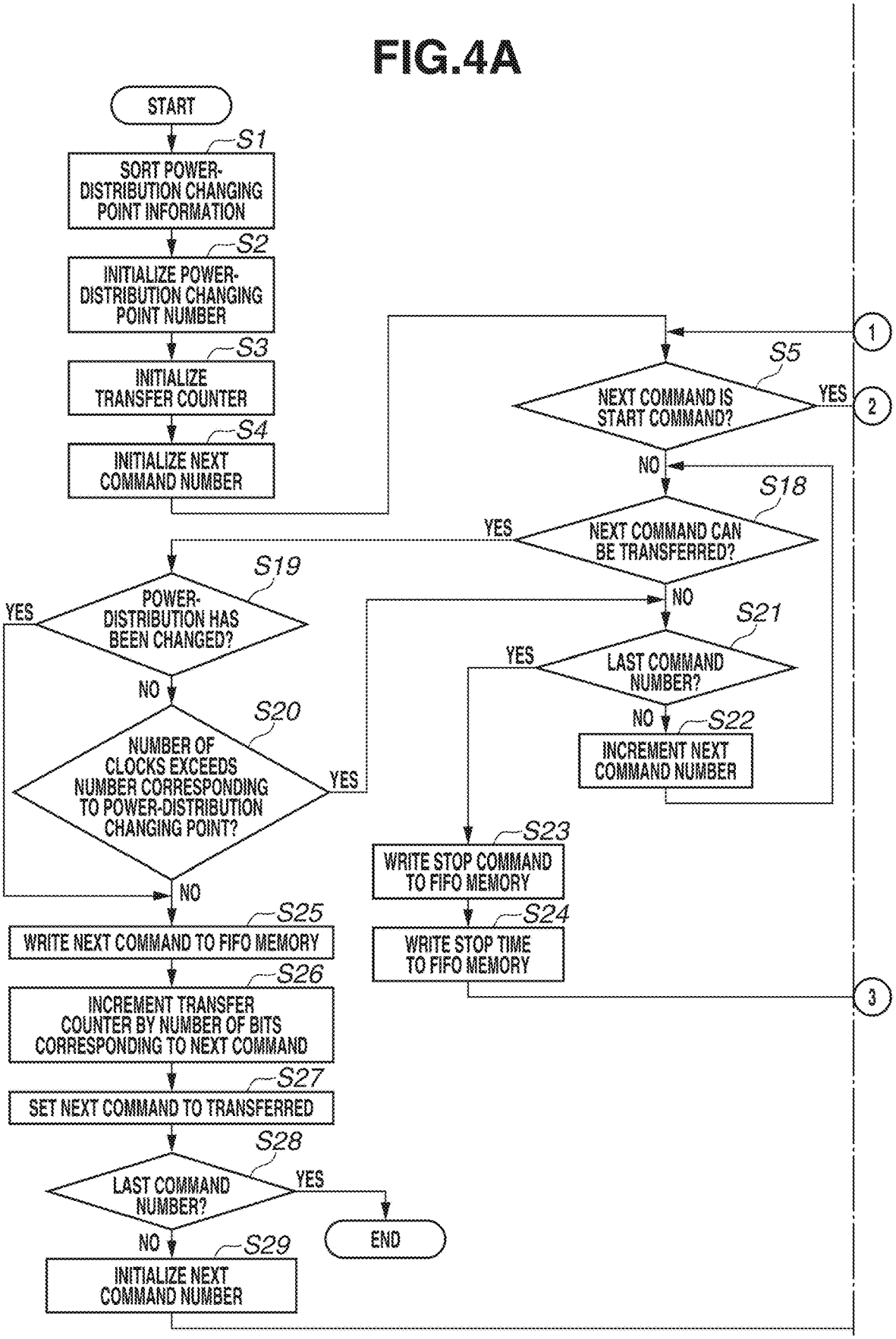
FIGS. 4A and 4B are a flowchart illustrating operation of a data array group generation unit of the image recording apparatus in FIG. 1.
Figure 4B:
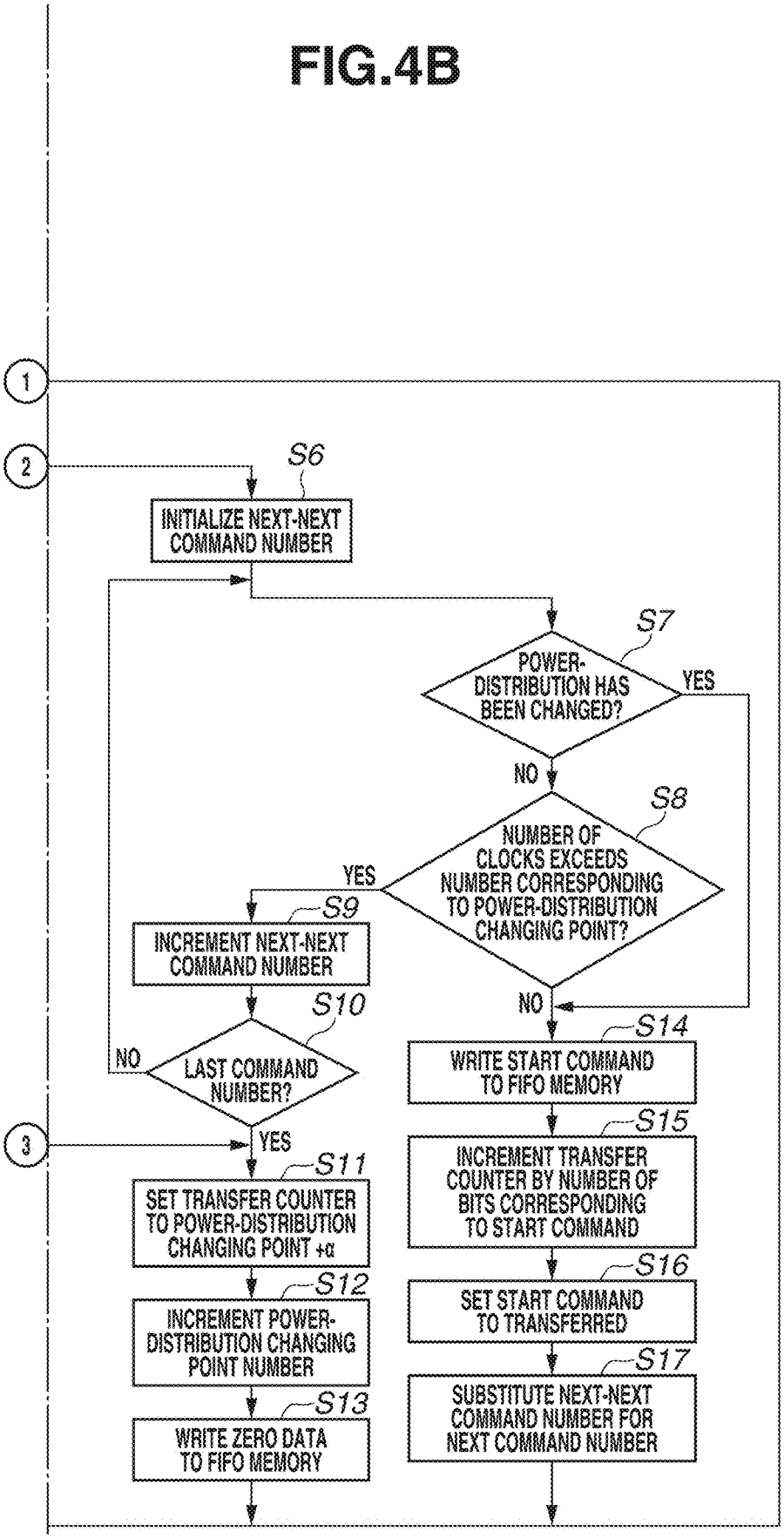

FIGS. 4A and 4B are a flowchart illustrating an operation flow for attaching a series of commands to the recording data. The control flow in FIGS. 4A and 4B is executed each time the latch signal LT rises up to the high level.

First, in step S1, the data array group generation unit 2010 sorts the power-distribution timing data PT11, PT12, PT21, and PT22 supplied from the latch circuit 2007 in the order of the earliest power-distribution changing point, and applies serial numbers thereto. In FIG. 3, for example, the power-distribution timings PT11 and PT21 are the same timings and represent the first power-distribution changing points. The power-distribution timing PT12 represents a next power-distribution changing point, and the power-distribution timing PT22 represents a power-distribution changing point next to the power-distribution changing point represented by the power-distribution timing PT12. In this case, the data array group generation unit 2010 determines that three power-distribution changing points exist in total, stores the power-distribution timings PT11, PT12, and PT22 as the power-distribution changing point information in this order, and adds numbers to the respective pieces of information.

In step S2, the data array group generation unit 2010 initializes a power-distribution changing point number to 1. The power-distribution changing point number indicates the information that should be regarded as a reference target from among the pieces of power-distribution changing point information sorted in step S1. In step S3, the data array group generation unit 2010 initializes a transfer counter for counting commands and an amount of data transferred to the FIFO memory of the transmission circuit 2011. In step S4, the data array group generation unit 2010 sets a start command as a command to be transfer next (next command). In step S5, the data array group generation unit 2010 determines whether the command to be transferred next is the start command.

In step S5, if the data array group generation unit 2010 determines that the next command is the start command (YES in step S5), the processing proceeds to step S6. In step S6, the data array group generation unit 2010 selects one command at the top of the commands which have not been transferred, and sets the one command as the next-next command. At this time, the command numbers 1 to 6, which represent attaching order of commands, are respectively allocated to the command attaching units 2001 to 2003, 2005, 2008, and 2009 in FIG. 2. A command at the top of the commands which have not been transferred refers to a command having the smallest command number from among the commands which have not been transferred.

In step S7, the data array group generation unit 2010 determines whether power-distribution has been changed at all of the power-distribution changing points sorted in steps S1 and S2. If power-distribution has been changed at all of the power-distribution changing points (YES in step S7), the processing proceeds to step S14. If power-distribution has not been changed at all of the power-distribution changing points (NO in step S7), the processing proceeds to step S8.

In step S8, the data array group generation unit 2010 determines whether the number of clocks necessary for transferring the next command, the next-next command, and the data attached to the commands exceeds the number corresponding to the power-distribution changing point. If the number of clocks exceeds the number corresponding to the power-distribution changing point (YES in step S8), the processing proceeds to step S9. If the number of clocks is not sufficient to exceed the power-distribution changing point (NO in step S8), the processing proceeds to step S14.

In step S9, the data array group generation unit 2010 increments the next-next command number in order to change the next-next command. In step S10, the data array group generation unit 2010 determines whether the command number of the next-next command changed in step S9 is the last command number. In the present exemplary embodiment, the last command number represents the command attached by the command attaching unit 2009. In the example in FIG. 2, the last command number is "6". If the command number is the last command number (YES in step S10), the processing proceeds to step S11. If the command number is not the last command number (NO in step S10), the processing returns to step S7. While repeatedly executing the processing in steps S7, S8, S9, and S10, the data array group generation unit 2010 determines whether one of the commands except for the start command and the last command, and data attached to that command can be transferred by the next power-distribution changing point to select the command.

In a case where one of the commands except for the start command and the last command, and data attached to that command can be transferred by the next power-distribution changing point, a determination result in step S7 is "YES". Therefore, the processing proceeds to step S14. In step S14, the data array group generation unit 2010 writes a code of the start command to the FIFO memory of the transmission circuit 2011. In step S15, the data array group generation unit 2010 increments the transfer counter by a number corresponding to a code length of the start command. In step S16, the data array group generation unit 2010 sets the start command to "transferred". In step S17, the data array group generation unit 2010 substitutes the command number of the next-next command selected through the processing in steps S7 to S10 for the next command number. The processing returns to step S5 after the processing in step S17.

In a case where one of the commands except for the start command and the last command, and data attached to that command cannot be transferred by the next power-distribution changing point, a determination result in step S10 is "YES". Therefore, the processing proceeds to step S11. In step S11, the data array group generation unit 2010 substitutes "+a", i.e., a value in which a certain margin is added to the value of the currently-referred power-distribution changing point, for the value of the transfer counter. In step S12, the data array group generation unit 2010 changes the power-distribution changing point number to the next power-distribution changing point number. In step S13, the data array group generation unit 2010 writes zero data corresponding to the counter value substituted in step S11 to the FIFO memory of the transmission circuit 2011. The processing returns to step S5 after step S13, and the data array group generation unit 2010 repeatedly determines whether the start command can be transferred by the next power-distribution changing point.

In step S5, if the data array group generation unit 2010 determines that the next command is not the start command (NO in step S5), the processing proceeds to step S18. In step S18, the data array group generation unit 2010 determines whether the next command has not been transferred and can be transferred. If the next command can be transferred (YES in step S18), the processing proceeds to step S19. In step S19, the data array group generation unit 2010 determines whether the power-distribution has been changed at the target power-distribution changing point. If the power-distribution has not been changed (NO in step S19), the processing proceeds to step S20.

In step S20, the data array group generation unit 2010 determines whether the number of clocks necessary for transferring the next command, data attached to the next command, and the stop command exceeds the number corresponding to the power-distribution changing point. If the number of clocks exceeds the number corresponding to the power-distribution changing point (YES in step S20), the processing proceeds to step S21. In step S21, the data array group generation unit 2010 determines whether the command number of the next command is the last command number. If the command number of the next command is not the last command number (NO in step S21), the processing returns to step S22. In step S22, the data array group generation unit 2010 increments the next command number. After the processing in step S22, the processing returns to step S18, and the processing in steps S18 to S22 is executed repeatedly, so that the data array group generation unit 2010 selects the command that can be transferred by the power-distribution changing point.

In step S21, if the command number of the next command is the last command number (YES in step S21), the processing proceeds to step S23. In step S23, the data array group generation unit 2010 writes a code of the stop command to the FIFO memory of the transmission circuit 2011. In step S24, the data array group generation unit 2010 writes data representing the number of counts of the stop time to the FIFO memory of the transmission circuit 2011. The processing proceeds to step S11 after step S24.

If the data array group generation unit 2010 determines that power-distribution has been changed at the target power-distribution changing point in step S19 (YES in step S19), and determines that the number of clocks is not sufficient to exceed the power-distribution changing point in step S20 (NO in step S20), the processing proceeds to step S25. In step S25, the data array group generation unit 2010 writes the next command and data attached to that command to the FIFO memory of the transmission circuit 2011. In step S26, the data array group generation unit 2010 increments the transfer counter by the number corresponding to the number of clocks necessary for transferring the next command and data attached to that command. In step S27, the data array group generation unit 2010 sets the next command to "transferred". In step S28, the data array group generation unit 2010 determines whether the command number of the next command is the last command number.

If the command number of the next command is the last command number (YES in step S28), this control processing flow is ended. If the command number of the next command is not the last command number (NO in step S28), the processing proceeds to step S29. In step S29, the data array group generation unit 2010 initializes the command number of the next command. The processing returns to step S5 after step S29, and the processing is repeatedly executed until there is no command to be transferred.

According to the above-described control processing flow, the stop command can be inserted immediately before the changing point of each of the heat enable signals HE1 and HE2, a data transfer stop time can be set, and transfer order of commands can be changed.

In addition, the CRC arithmetic circuit of the command attaching unit 2009 is reset when the start command is output, and thereafter, recalculation is executed each time data corresponding to 1-bit is output. However, with respect to several bits of data in a standby section set immediately after the stop command and the stop time data, even if the transmission data is changed due to noise, the CRC arithmetic circuit does not execute recalculation in order to prevent adverse effect on the operation of the recording head 6.

Next, the operation of the command analysis unit 614 of the recording head 6 will be described in detail.

Figure 5:
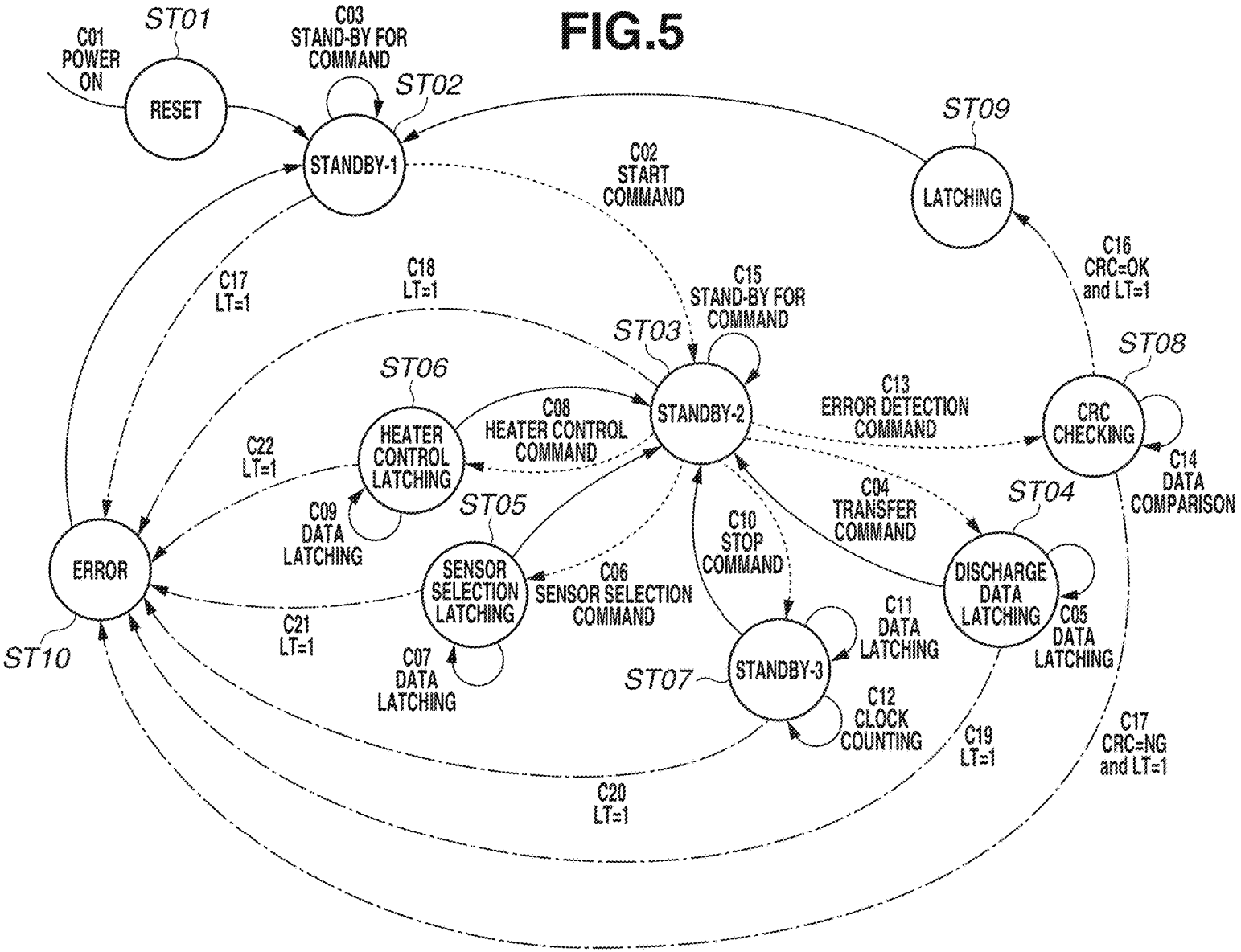
FIG. 5 is a state transition diagram illustrating operation of a command analysis unit of the image recording apparatus in FIG. 1.

FIG. 5 is a state transition diagram illustrating the operation of the command analysis unit 614.

A state transition condition C01 is to turn on the power of the recording head 6. When the state transition condition C01 is satisfied, the command analysis unit 614 shifts to a reset in state ST01. In the reset in the state ST01, states of various data latch circuits of the recording head 6 are reset. After the reset in state ST01, the command analysis unit 614 shifts to a standby-1 in state ST02.

In the standby-1 in the state ST02, the command analysis unit 614 waits for data to be transferred in synchronization with the clock. A state transition condition C02 is to receive a start command. The state transition condition C02 is satisfied when a command included in the data TXD is the start command. When the state transition condition C02 is satisfied, the command analysis unit 614 shifts to a standby-2 in state ST03. If the state transition condition C02 is not satisfied, a state transition condition C03 of "stand-by for a command" is satisfied. As a result, the command analysis unit 614 stays in the standby-1 in the state ST02.

In the standby-2 in state ST03, the command analysis unit 614 analyzes the command transferred in synchronization with the clock, and shifts to each of the states for latching data attached to the command. The state transition and the operation for each command will be described.

A state transition condition C04 is to receive a transfer command of image data. The state transition condition C04 is satisfied when the command is the transfer command of image data. When the state transition condition C04 is satisfied, the command analysis unit 614 shifts to a discharge data latching in state ST04 from the standby-2 in state ST03. A state transition condition C05 is to store discharge data in a shift register, by a number of clocks corresponding to the attached data. When the state transition condition C05 is satisfied in the discharge data latching in the state ST04, the command analysis unit 614 returns to the standby-2 in the state ST03.

A state transition condition C06 is to receive a sensor selection command. The state transition condition C06 is satisfied when the command is the sensor selection command. When the state transition condition C06 is satisfied, the command analysis unit 614 shifts to a sensor selection latching in state ST05 from the standby-2 in the state ST03. A state transition condition C07 is to store sensor numbers in a shift register, by a number of clocks corresponding to the attached data. When the state transition condition C07 is satisfied in the sensor selection latching in the state ST05, the command analysis unit 614 returns to the standby-2 in the state ST03.

A state transition condition C08 is to receive a heater control command. The state transition condition C08 is satisfied when the command is the heater control command. When the state transition condition C08 is satisfied, the command analysis unit 614 shifts to a heater selection latching in state ST06 from the standby-2 in the state ST03. A state transition condition C09 is to store heater control data in a shift register, by a number of clocks corresponding to the attached data. When the state transition condition C09 is satisfied in the heater selection latching in the state ST06, the command analysis unit 614 returns to the standby-2 in the state ST03.

A state transition condition C13 is to receive an error detection command. The state transition condition C13 is satisfied when the command is the error detection command. When the state transition condition C13 is satisfied, the command analysis unit 614 shifts to a CRC checking in state from the standby-2 state ST03. A state transition condition C14 is to stay in the CRC checking in the state ST08, by a number of clocks corresponding to the attached data. When the state transition condition C14 is satisfied in the CRC checking in state ST08, the command analysis unit 614 returns to the standby-2 in the state ST03.

A state transition condition C15 is to receive a data array other than the above described series of commands, i.e., the start command, the transfer command, the sensor selection command, the heater control command, the stop command, and the error detection command. When the state transition condition C15 is satisfied in the standby-2 in the state ST03, the command analysis unit 614 stays in the standby-2 in the state ST03.

The CRC arithmetic circuit for detecting an error of the transfer data is used in the recording head 6. This CRC arithmetic circuit uses the polynomial expression similar to the polynomial expression used on the transmission side. A state of the CRC arithmetic circuit is reset when the standby-1 in the state ST02 is shifted to the standby-2 in the state ST03. After that, the CRC calculation is updated each time data corresponding to 1 bit is transferred. However, the CRC calculation is not updated while clock counting specified by the state transition condition C12 is being executed in a standby-3 in state ST07.

In a case where a specified value is acquired as a calculation result of the CRC arithmetic circuit at a timing when the state transition condition C14 is satisfied in the CRC checking in state ST08, this indicates that the data is transferred normally (CRC=OK). In a case where a value different from the specified value is acquired as the calculation result of the CRC arithmetic circuit, this indicates that an error has occurred in the data (CRC=NG).

A state transition condition C16 is rise of the latch signal LT to the high level (LT=1). The state transition condition C16 is satisfied when the latch signal LT rises up to the high level in a state where the CRC is OK (CRC=OK). When the state transition condition C16 is satisfied, the command analysis unit 614 shifts to a latching in state ST09 from the state of "CRC=OK". In the latching in the state ST09, values stored in the respective shift registers are stored in respective latches within the recording data retaining circuits 605 and 606 and the latch circuits 609 and 611 illustrated in FIG. 2. Thereafter, the command analysis unit 614 returns to the standby-1 in the state ST02 and waits for the next command.

A state transition condition C17 is rise of the latch signal LT to the high level. The state transition condition C17 is satisfied when the latch signal LT rises up to the high level in a state where the CRC is NG (CRC=NG). When the state transition condition C17 is satisfied, the command analysis unit 614 shifts to an error in the state ST10 from the state of "CRC=NG". In the error in state ST10, an error flag is set, the heat enable signals HE1 and HE2 and the heater control signal are suppressed, and power is not supplied to the recording head 6.

Further, in a case where the latch signal LT rises up to the high level (i.e., in a case where the state transition conditions C17 to C22 are satisfied) while the command analysis unit 614 is staying in the states ST02 to ST07 where transfer of the command has not been completed, the command analysis unit 614 shifts to the error in the state ST10, so that power is not supplied to the recording head 6.

According to the image recording apparatus of the present exemplary embodiment described above, the data transfer unit 104 transfers, to the recording head 6, recording data to which the series of commands is attached, in synchronization with the clock. The series of commands includes a stop command for temporarily stopping transfer of the recording data for only a predetermined period in accordance with the power-distribution timing of the recording elements. Although the crosstalk noise is generated in the predetermined period, the recording data is not influenced thereby because the recording data is not transferred. The recording data can be precisely latched in a period when the crosstalk noise is not generated.

Further, the clock used for transferring the recording data does not have to be stopped in order to reduce the influence of the crosstalk noise, either. Accordingly, when the clock used for transferring data is also used as the clock for operating the circuit within the recording head 6, the circuit can be operated normally without any issue.

Further, in order to realize rapid recording, there have been an increase in the number of recording element arrays and an improvement in driving speed of recording elements. At the same time, efforts have been also made to increase a clock speed. The recording apparatus discussed in Japanese Patent Application Laid-Open No. 2000-25228 needs to stop a clock for a period corresponding to one-clock or more in order to reduce the influence of the crosstalk noise. This stop period of the clock could be a factor of preventing realization of rapid recording. The image recording apparatus according to the present exemplary embodiment is beneficial for realizing rapid recording because it is not necessary to stop the clock.

Further, if the recording head 6 is moved as in a case of a serial printer, the number of signal lines should be reduced as much as possible because the transfer path 12 is long, and the recording head 6 is moved in a sliding state. Because the image recording apparatus of the present exemplary embodiment serially transfers the recording data by a series of commands, the number of signal lines arranged on the transfer path 12 can be reduced.

In the image recording apparatus of the present exemplary embodiment, the recording head 6 includes the two recording element arrays 601 and 602. However, the configuration is not limited thereto. The number of recording element arrays may be three or more. In a case where three or more recording element arrays are arranged, a heat enable signal and a data transfer command are generated for each of the recording element arrays, and a stop command is attached at a rising timing and a falling timing of the heat enable signal. Then, the command analysis unit 614 allocates data based on a command.

Further, in a case where the number of recording element arrays is increased, and one clock line and one data line are not sufficient for the transfer band of data, a plurality of data lines may be used. In this case, the data array group generation unit 2010 allocates the commands to a plurality of data lines, and the command analysis unit 614 analyzes the commands for each of the data lines.

In the first exemplary embodiment, the crosstalk noise superimposed on the data TXD is reduced as illustrated in FIG. 3. However, because the crosstalk noise is superimposed on the clock TCLK, subsequent command analysis may not be executed precisely if there arises any difference in the clock count in the standby-3 state in FIG. 5. The image recording apparatus according to a second exemplary embodiment realizes precise command analysis by adding a restart command for restarting data transfer to a series of commands.

The image recording apparatus of the present exemplary embodiment is different from that of the first exemplary embodiment in that the data transfer unit 104 attaches, to a recording data, a restart command of data transfer in addition to a start command, a transfer command, a sensor selection command, a heater control command, a stop command, and an error detection command.

Figure 6:
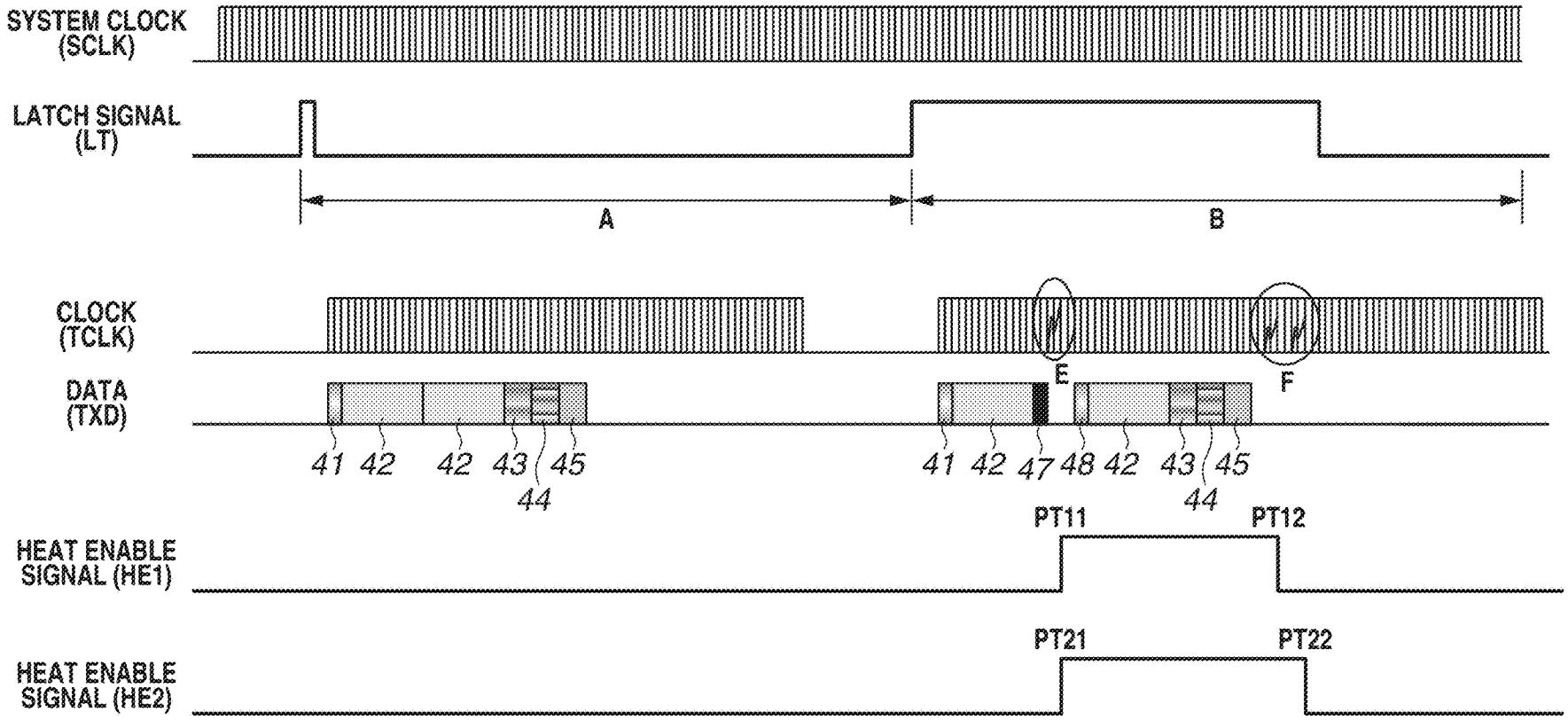
FIG. 6 is a timing chart illustrating a relationship between a command and a heat enable signal of an image recording apparatus according to a second exemplary embodiment of the disclosure.

FIG. 6 is a timing chart illustrating operation for transferring recording data to which a series of commands of the data transfer unit 104 is attached. In FIG. 6, the system clock SCLK, the latch signal LT, the clock TCLK, the data TXD, and the heat enable signals HE1 and HE2 are illustrated in this order from the top.

Similar to the first exemplary embodiment, in a section A, the data TXD signal to which the series of commands is attached is serially transferred in synchronization with the clock TCLK. As the series of commands, a start command 41 of data transfer, an image data transfer command 42 for each of the recording element arrays 601 and 602, a sensor switching command 43, a heater control command 44, and an error detection command 45 are transferred in this order.

In a section B, when the data TXD signal to which the series of commands is attached is serially transferred in synchronization with the clock TCLK, a stop command 47 and a restart command 48 are included in the series of commands. The stop command 47 is transferred immediately before a section E in which the crosstalk noise is superimposed on the clock TCLK. The restart command 48 is transferred immediately after a section E, i.e., when a predetermined time has passed after the stop command 47 is transferred. After the restart command 48 is transferred, the image data transfer command 42 for the recording element array 602, the sensor switching command 43, the heater control command 44, and the error detection command 45 are transferred in this order.

Further, in a section F, although the crosstalk noise is also superimposed on the clock TCLK, a command is not transferred because all of commands and data have been transferred already.

Next, a flow of processing procedure for transferring recording data to which the series of commands is attached will be described in detail.

Figure 7A:
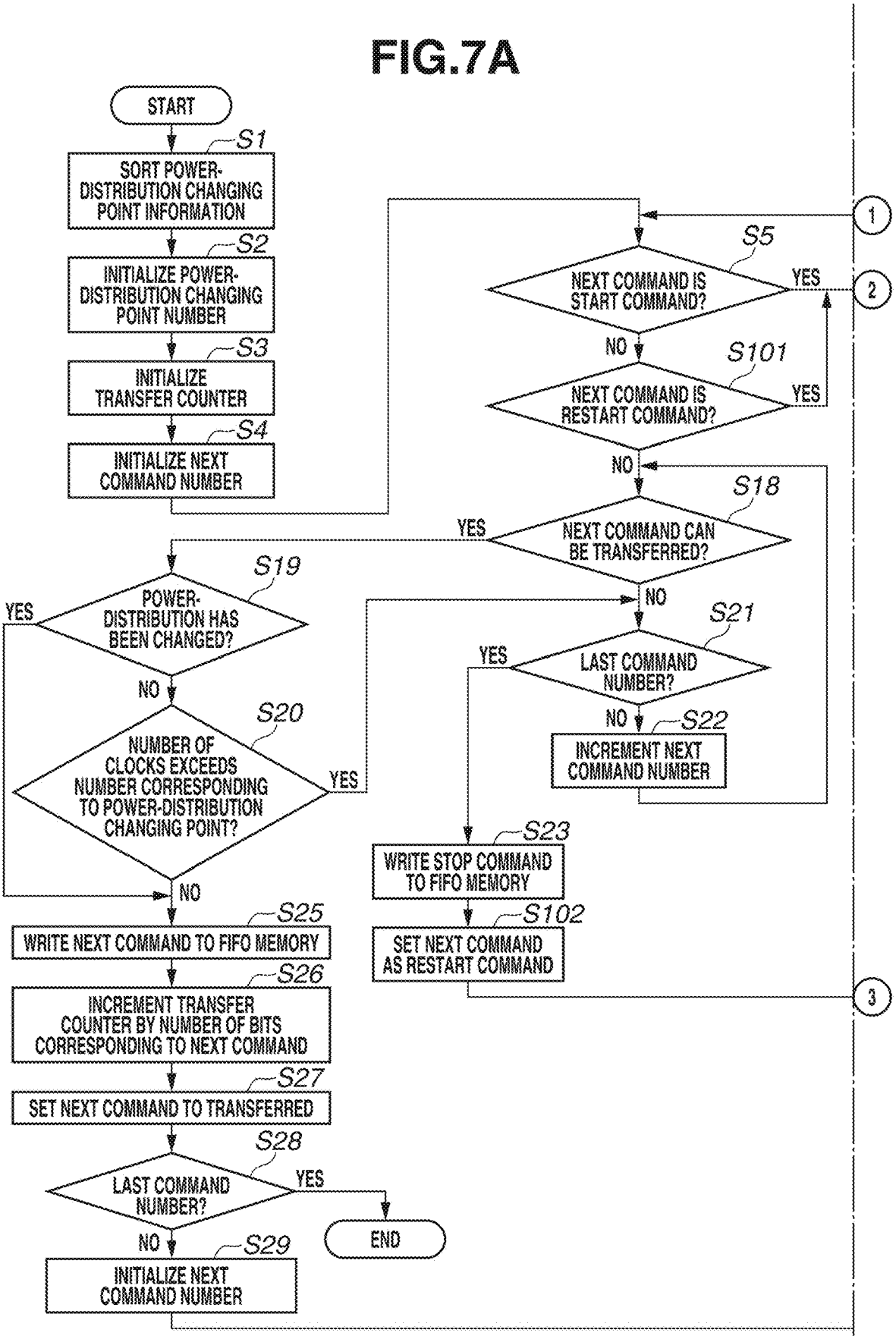
FIGS. 7A and 7B are a flowchart illustrating operation of a data array group generation unit of the image recording apparatus according to the second exemplary embodiment of the disclosure.
Figure 7B:
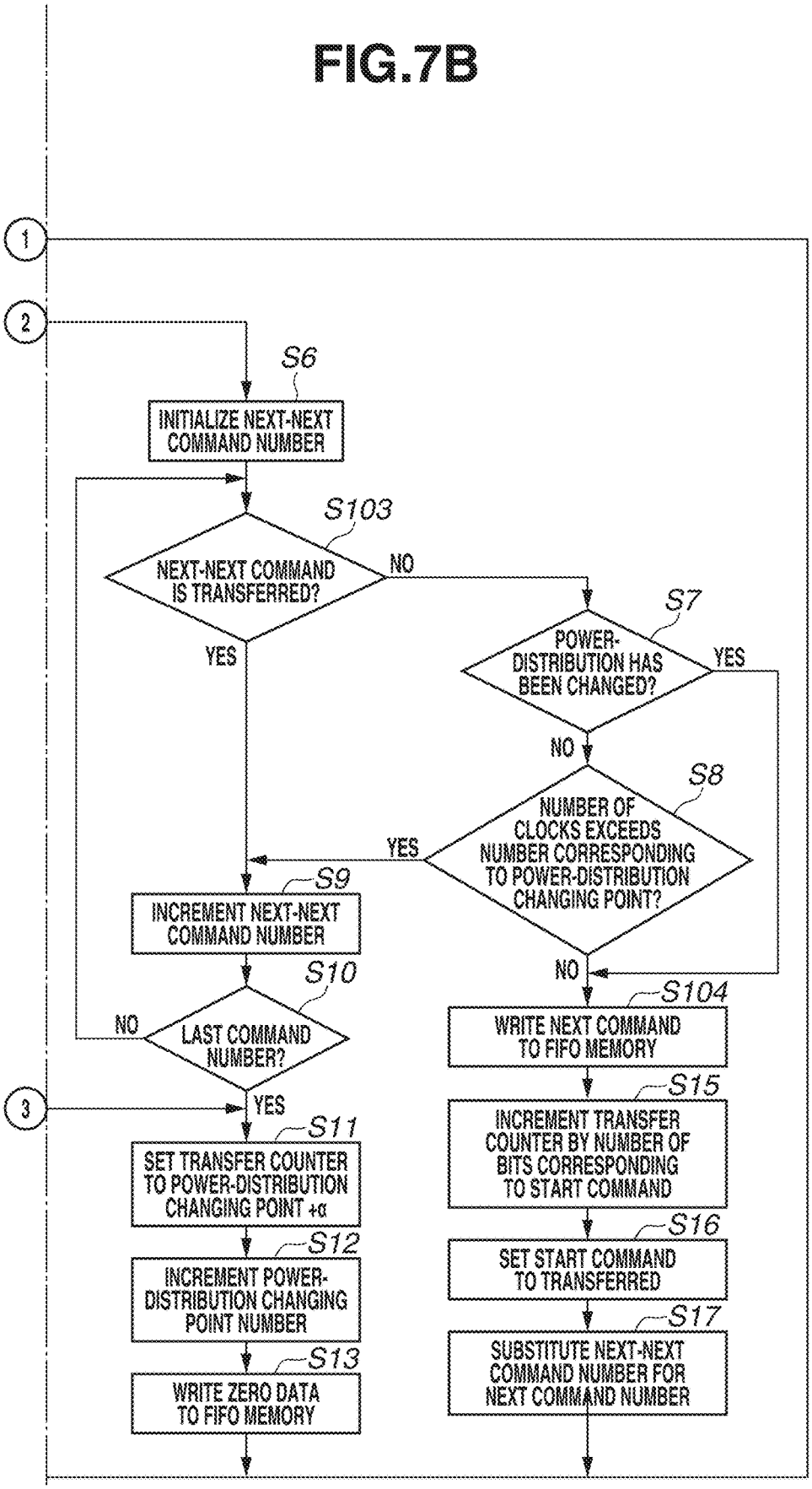

FIGS. 7A and 7B are a flowchart illustrating a control flow for attaching a series of commands to recording data. The control flow in FIGS. 7A and 7B is executed each time the latch signal LT rises up to the high level. The control flow in FIGS. 7A and 7B is different from the control flow illustrated in FIGS. 4A and 4B in that steps S101 and S103 are added, a step S104 is added instead of step S14, and a step S102 is added instead of step S24. The processing performed in steps S1 to S13, S15 to S23, and S25 to 29 is similar to the processing illustrated performed in FIGS. 4A and 4B, so that detailed descriptions thereof will be omitted.

In step S5, if the data array group generation unit 2010 determines that the next command is not the start command (NO in step S5), the processing proceeds to step S101. In step S101, the data array group generation unit 2010 determines whether the next command is the restart command.

In step S101, if the data array group generation unit 2010 determines that the next command is not the restart command (NO in step S101), the processing proceeds to step S18. After the data array group generation unit 2010 determines that the next command cannot be transferred in step S18 (NO in step S18) and determines that the command number of the next command is the last command number in step S21 (YES in step S21), the processing proceeds to step S23. In step S23, a code of the stop command is written into the FIFO memory of the transmission circuit 2011. The processing proceeds to step S102 after step S23. In step S102, the data array group generation unit 2010 sets the next command to the restart command 48. The processing proceeds to step S1 after step S102.

In step S101, if the data array group generation unit 2010 determines that the next command is the restart command (YES in step S101), the processing proceeds step S103 via step S6. In step S103, the data array group generation unit 2010 determines whether the next-next command has been transferred.

In step S103, if the data array group generation unit 2010 determines that the next-next command has been transferred (YES in step S103), the processing proceeds to step S9. If the next-next command number is incremented in step S9, and the data array group generation unit 2010 determines that the command number of the next-next command is not the last command number in step S10 (NO in step S10), the processing returns to step S103.

In step S103, if the data array group generation unit 2010 determines that the next-next command has not been transferred (NO in step S103), the processing proceeds to step S7. If the data array group generation unit 2010 determines that power-distribution has been changed at all of the power-distribution changing points in step S7 (YES in step S7), or if the data array group generation unit 2010 determines that power-distribution has not been changed in step S7 (NO in step S7) and also determines that the number of clocks is not sufficient to exceed the power-distribution changing point in step S8 (NO in step S8), the processing proceeds to step S104. In step S104, the data array group generation unit 2010 writes a code of the next command to the FIFO memory of the transmission circuit 2011. The processing proceeds to step S15 after step S104.

Through the above-described control flow, it is possible to insert a command, set a stop period, and change the transfer order of commands. For example, it is possible to insert a stop command immediately before the section E and insert a restart command immediately after the section E illustrated in FIG. 6.

Next, the operation of the command analysis unit 614 of the recording head 6 will be described in detail.

Figure 8:
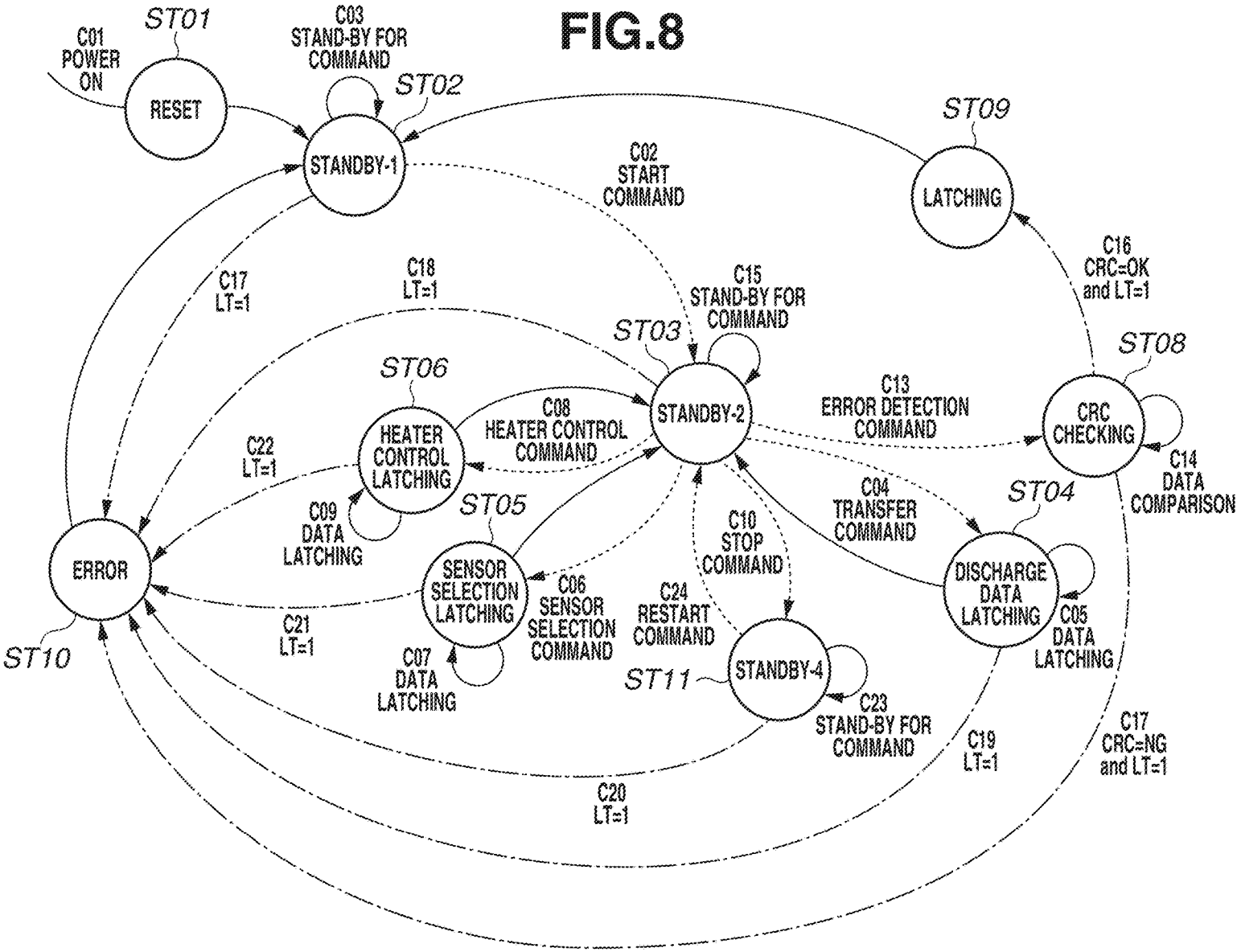
FIG. 8 is a state transition diagram illustrating operation of a command analysis unit of the image recording apparatus according to the second exemplary embodiment of the disclosure.

FIG. 8 is a state transition diagram illustrating the operation of the command analysis unit 614. The state transition diagram in FIG. 8 is different from the state transition diagram in FIG. 5 in that a standby-4 in state ST11 is set instead of the standby-3 in the state ST07. Detailed description will be omitted with respect to the portion similar to the state transition diagram in FIG. 5.

When the state transition condition C10 is satisfied, the command analysis unit 614 shifts to the standby-4 in the state ST11 from the standby-2 in the state ST03. A state transition condition C23 is to consistently stay in the standby-4 in the state ST11 when a command code is different from the restart command. A state transition condition C24 is to receive a restart command. When the state transition condition C23 is satisfied in the standby-4 in the state ST11, the command analysis unit 614 consistently stays in the standby-4 in the state ST11. When the state transition condition C24 is satisfied, the command analysis unit 614 returns to the standby-2 in the state ST03.

The effect similar to the effect achieved in the first exemplary embodiment is achieved by the image recording apparatus of the present exemplary embodiment.

In addition, in the standby-4 in the state ST11, the command analysis unit 614 consistently stay in the standby-4 in the state ST11 when the command code is different from the restart command. Therefore, even if the crosstalk noise is superimposed on the data TXD and the clock TCLK, the command analysis unit 614 can analyze the command without making any mistake unless the code is corrupted into the code of the restart command 48.

In the first exemplary embodiment, the heat enable signals HE1 and HE2 are generated by the latch circuit 2007 of the data transfer unit 104. In this case, if the number of recording element arrays is increased, the number of signal lines of the transfer path 12 for transferring the heat enable signals is also increased. In an image recording apparatus according to a third exemplary embodiment of the disclosure, the heat enable signal is generated by a recording head in order to reduce the number of signal lines of the transfer path 12.

FIG. 9 is a block diagram illustrating a detailed configuration of a portion relating to data transfer of the image recording apparatus of the present exemplary embodiment. A configuration of the image recording apparatus in FIG. 9 is similar to the configuration of the image recording apparatus in FIG. 2 except for a data transfer unit 201 and a recording head 202 arranged in place of the data transfer unit 104 and the recording head 6. Detailed description of the similar configuration will be omitted.

A configuration of the data transfer unit 201 is similar to that of the data transfer unit 104 except that a command attaching unit 3001 is added, and that the operations executed by the latch circuit 2007 and the data array group generation unit 2010 are different. A configuration of the recording head 202 is similar to that of the recording head 6 except that a latch circuit 3003 and a pulse generation circuit 3004 are added, and that the operation executed by the command analysis unit 3002 is different. Detailed description of the similar configuration will be omitted.

In the data transfer unit 201, power-distribution timing data PT11, PT12, PT21, and PT22 output from the power-distribution timing generation unit 1032 are supplied to the latch circuit 2007 and the command attaching unit 3001. The command attaching unit 3001 attaches a timing command including an HE timing command code at the beginning of each of the power-distribution timing data PT11, PT12, PT21, and PT22. The command attaching unit 3001 supplies the timing command to the data array group generation unit 2010.

The data array group generation unit 2010 transmits commands and data respectively output from the command attaching units 2001 to 2003, 2005, 2008, 2009, and 3001 to the FIFO memory of the transmission circuit 2011. Transmission order of the commands and data to the FIFO memory is determined based the power-distribution start timing data PT11 and PT21 and the power-distribution end timing data PT12 and PT22 output from the latch circuit 2007. The transmission circuit 2011 transmits recording data to which the series of commands is attached, which is stored in the FIFO memory, to the reception circuit 613 of the recording head 202.

The latch signal LT output from the sensor control unit 105 is supplied to the command analysis unit 3002, the latch circuit 3003, and the pulse generation circuit 3004 of the recording head 202 via the data transfer unit 201. The command analysis unit 3002 of the recording head 202 supplies data to the latch circuits 609 and 611, the recording data retaining circuits 605 and 606, and the latch circuit 3003 based on a result of command analysis. The data supplied to the latch circuit 3003 is the power-distribution timing data PT11, PT12, PT21, and PT22 transferred by the timing command.

The latch circuit 3003 latches the power-distribution timing data PT11, PT12, PT21, and PT22 supplied from the command analysis unit 3002 at a rising timing of the latch signal LT. The latch circuit 3003 supplies the latched power-distribution timing data PT11, PT12, PT21, and PT22 to the pulse generation circuit 3004.

The pulse generation circuit 3004 includes an internal counter operated by the system clock SCLK. The pulse generation circuit 3004 generates the heat enable signals HE1 and HE2 for discharging liquid by using the internal counter. The pulse generation circuit 3004 supplies the heat enable signal HE1 to the recording element driving circuit 603 and supplies the heat enable signal HE2 to the recording element driving circuit 604.

Figure 10:
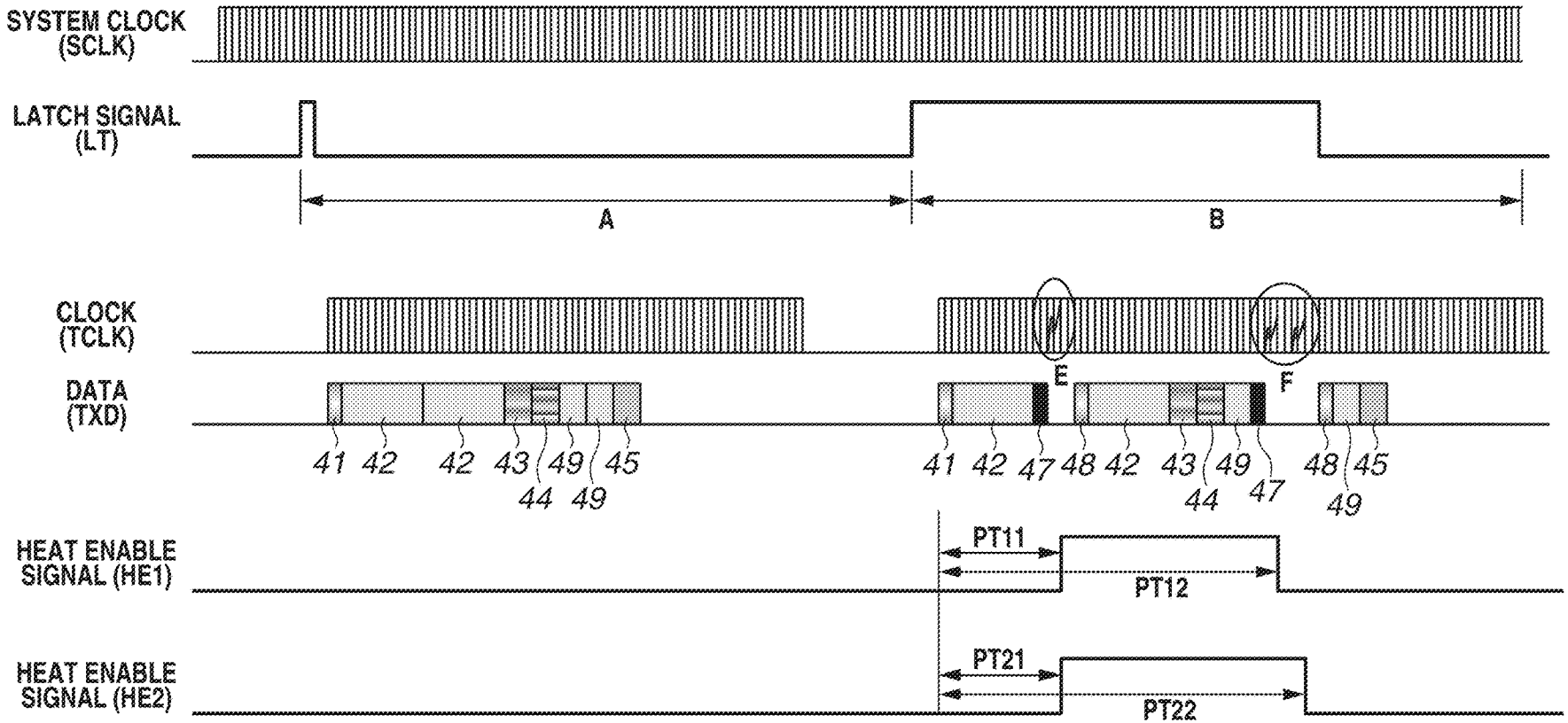
FIG. 10 is a timing chart illustrating a relationship between a command and a heat enable signal of the image recording apparatus in FIG. 9.

FIG. 10 is a timing chart illustrating a relationship between the recording data to which the series of commands is attached by the data transfer unit 201, and the heat enable signals HE1 and HE2. In FIG. 10, the system clock SCLK, the latch signal LT, the clock TCLK, the data TXD, and the heat enable signals HE1 and HE2 are illustrated in this order from the top.

In a section A, the data TXD signal to which the series of commands is attached is serially transferred in synchronization with the clock TCLK. First, the start command 41 is transferred. Subsequent to the start command 41, a transfer command 42 for the recording element array 601, an image data transfer command 42 for the recording element array 602, a sensor switching command 43, and a heater control command 44, are transferred in this order. Subsequent to the heater control command 44, a timing command 49 for the recording element array 601 and a timing command 49 for the recording element array 602 are transferred. Lastly, the error detection command 45 is transferred.

In a section B, the pulse generation circuit 3004 resets the counter at a rising timing of the latch signal LT and counts up the counter each time the clock TCLK is supplied thereto. The pulse generation circuit 3004 sets the heat enable signal HE1 to the high level at a timing when the counter value reaches a value corresponding to the power-distribution start timing PT11, and sets the heat enable signal HE1 to the low level at a timing when the counter value reaches a value corresponding to the power-distribution end timing PT12. Similarly, the pulse generation circuit 3004 sets the heat enable signal HE2 to the high level at a timing when the counter value reaches a value corresponding to the power-distribution start timing PT21, and sets the heat enable signal HE2 to the low level at a timing when the counter value reaches a value corresponding to the power-distribution end timing PT22. The electric current flows to the recording elements of the recording element array 601 in a period when the heat enable signal HE1 is at the high level. The electric current flows to the recording elements of the recording element array 602 in a period when the heat enable signal HE2 is at the high level.

In the section B, when the data TXD signal to which the series of commands is attached is serially transferred in synchronization with the clock TCLK, a stop command 47 and a restart command 48 are included in the series of commands. The section B includes a section E in which the crosstalk noise is superimposed on the clock TCLK at rising timings of the heat enable signals HE1 and HE2, and a section F in which the crosstalk noise is superimposed on the clock TCLK at falling timings of the heat enable signals HE1 and HE2. In the present exemplary embodiment, because of an increase in the number of commands to be transferred and an increase in the amount of data, recording data to which the series of commands is attached cannot be transferred by the section F. Therefore, the stop command 47 and the restart command 48 are inserted with respect to each of the sections E and F.

The stop command 47 is transferred immediately before the section E. The restart command 48 is transferred immediately after the section E, i.e., when a predetermined time has passed after the stop command 47 is transferred. After the restart command 48 is transferred, the image data transfer command 42 for the recording element array 602, the sensor switching command 43, the heater control command 44, and the timing command 49 for the recording element array 601 are transferred in this order.

The stop command 47 is transferred immediately before the section F. The restart command 48 is transferred immediately after the section F, i.e., when a predetermined time has passed after the stop command 47 is transferred. After the restart command 48 is transferred, the timing command 49 for the recording element array 602 is transferred. Lastly, the error detection command 45 is transferred.

Figure 11:
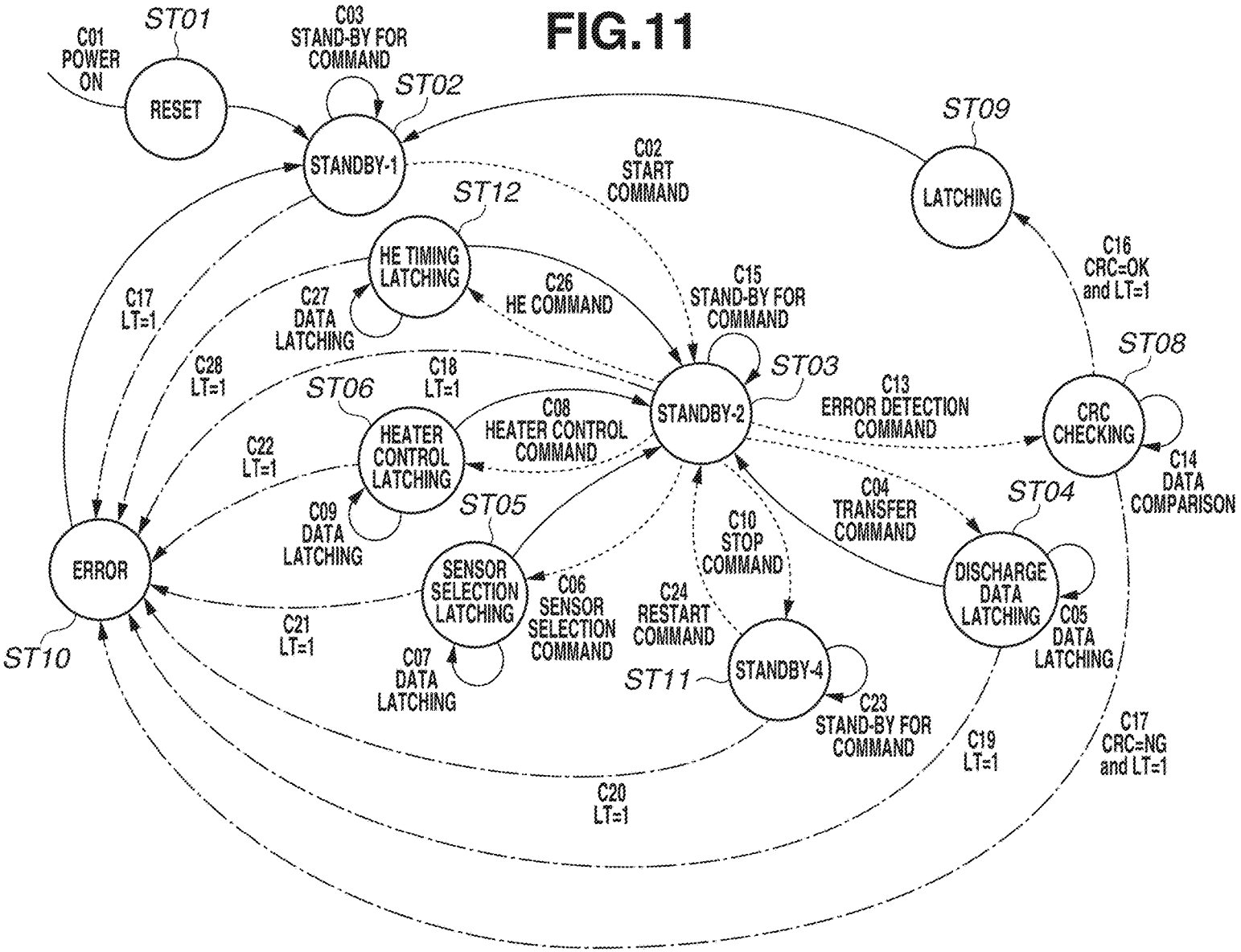
FIG. 11 is a state transition diagram illustrating operation of a command analysis unit of the image recording apparatus in FIG. 9.

FIG. 11 is a state transition diagram illustrating the operation of the command analysis unit 3002. The state transition diagram in FIG. 11 is different from the state transition diagram in FIG. 8 in that an HE timing latching in state ST12 is added. Detailed description will be omitted with respect to a portion similar to the state transition diagram in FIG. 8.

In the standby-2 in state ST03, the command analysis unit 3002 analyzes the command transferred in synchronization with the clock, and shifts to each of the states for latching data attached to the command.

A state transition condition C26 is to receive a timing command. The state transition condition C26 is satisfied if the command received in the standby-2 in the state ST03 is the timing command. When the state transition condition C26 is satisfied, the command analysis unit 3002 shifts to the HE timing latching in state ST12 from the standby-2 in the state ST03. A state transition condition C27 is to store PT position numbers and position data in a shift register, by a number of clocks corresponding to the attached data. When the state transition condition C27 is satisfied in the HE timing latching in state ST12, the command analysis unit 3002 returns to the standby-2 in the state ST03.

A state transition condition C22 is rise of the latch signal LT to the high level. The state transition condition 22 is satisfied if the latch signal LT rises up to the high level while the command analysis unit 3002 is staying in the HE timing latching in the state ST12. If the state transition condition C22 is satisfied, the command analysis unit 3002 shifts to the error in state ST10 from the HE timing latching in the state ST12, so that power is not supplied to the recording head 202.

The effect similar to the effect achieved in the first and the second exemplary embodiments is achieved by the image recording apparatus of the present exemplary embodiment.

Further, because the power-distribution timing data PT11, PT12, PT21, and PT22 is transferred by the timing command, the number of signal lines for the transfer path 12 can be reduced compared to the first and the second exemplary embodiments.

In addition, in the image recording apparatus of the present exemplary embodiment, because the power-distribution timing data is transferred by adding the timing command to the series of commands, a transfer band of data is increased. Similar to the case of the first exemplary embodiment, a plurality of data lines may be used in a case where one clock line and one data line are not sufficient for the transfer band of data. In this case, the data array group generation unit 2010 allocates the commands to a plurality of data lines, and the command analysis unit 3002 analyzes the commands for each of the data lines.

When the heat enable signals HE1 and HE2 rise or fall at different timings, a level of the crosstalk noise is lower than a level of the crosstalk noise generated when the heat enable signals HE1 and HE2 rise or fall at the same timing. Further, because the level of the crosstalk noise is changed in proportion to the number of recording elements turned on simultaneously in the recording element array, the level of the crosstalk noise is low if the number of recording elements simultaneously turned on is small. In a case where the level of the crosstalk noise is low, the crosstalk noise may not have an influence on the data transfer clock and the data.

In the image recording apparatus according to a fourth exemplary embodiment of the disclosure, a stop command is attached if the heat enable signals HE1 and HE2 rise or fall at the same timing, or if the number of recording elements simultaneously turned on is the threshold value or more.

Figure 12:
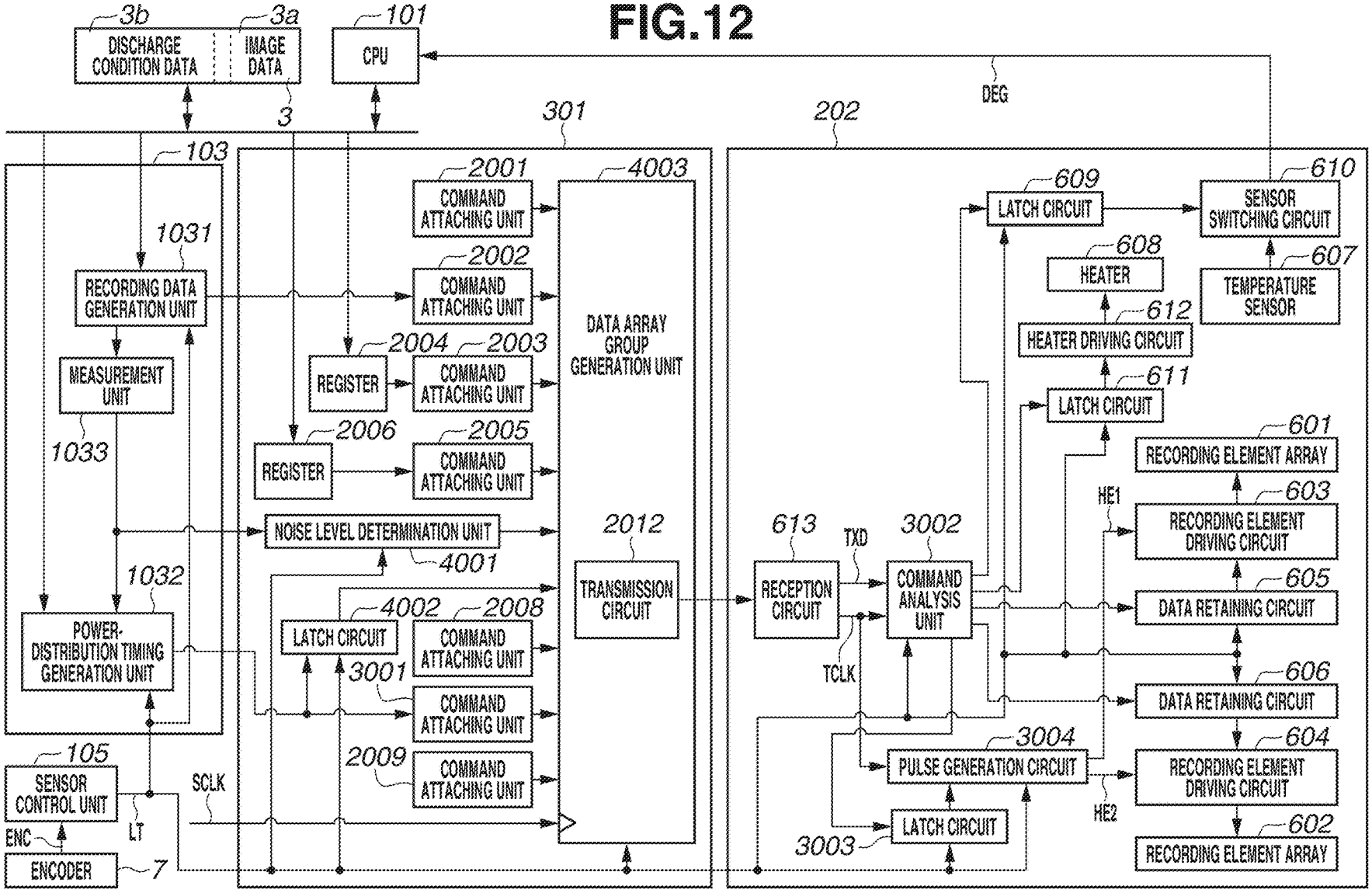
FIG. 12 is a block diagram illustrating a configuration of a portion relating to data transfer of an image recording apparatus according to a fourth exemplary embodiment of the disclosure.

FIG. 12 is a block diagram illustrating a detailed configuration of a portion relating to data transfer of the image recording apparatus of the present exemplary embodiment of the disclosure. A configuration of the image recording apparatus in FIG. 12 is similar to that of the image recording apparatus in FIG. 9 except for a data transfer unit 301 arranged in place of the data transfer unit 201. Detailed description of the similar configuration will be omitted.

A configuration of the data transfer unit 301 is similar to that of the data transfer unit 204 except that a noise level determination unit 4001 is added thereto, and that a latch circuit 4002 and a data array group generation unit 4003 are arranged instead of the latch circuit 2007 and the data array group generation unit 2010.

The measurement unit 1033 supplies a measurement value of the number of discharges to the power-distribution timing generation unit 1032 and the noise level determination unit 4001. The number of discharges corresponds to the number of recording elements turned on simultaneously in the same recording element array. The measurement unit 1033 supplies the measurement value of the number of discharges of each of the recording element arrays to the noise level determination unit 4001. For each of the recording element arrays, the noise level determination unit 4001 determines whether the measurement value of the number of discharges received from the measurement unit 1033 is a threshold value or more, and supplies a determination result to the data array group generation unit 4003.

The latch circuit 4002 latches the power-distribution timing data PT11, PT12, PT21, and PT22 supplied from the power-distribution timing generation unit 1032 again at a rising timing of the latch signal LT. The latch circuit 4002 supplies the latched power-distribution timing data PT11, PT12, PT21, and PT22 to the data array group generation unit 4003.

Based on the determination result received from the noise level determination unit 4001 and the power-distribution timing data received from the latch circuit 4002, the data array group generation unit 4003 determines whether the crosstalk noise at the power-distribution changing point is at a level at which data corruption occurs. For example, if the measurement value of the number of discharges is the threshold value or more, or if the power-distribution timing data PT11 matches the power-distribution timing data PT21 (or the power-distribution timing data PT12 matches the power-distribution timing data PT22), the data array group generation unit 4003 determines that the noise is in a level at which data corruption occurs. If the noise is at a level at which data corruption occurs, the data array group generation unit 4003 inserts a stop command. If the noise is not at a level at which data corruption occurs, the data array group generation unit 4003 does not inert the stop command.

Figure 13:
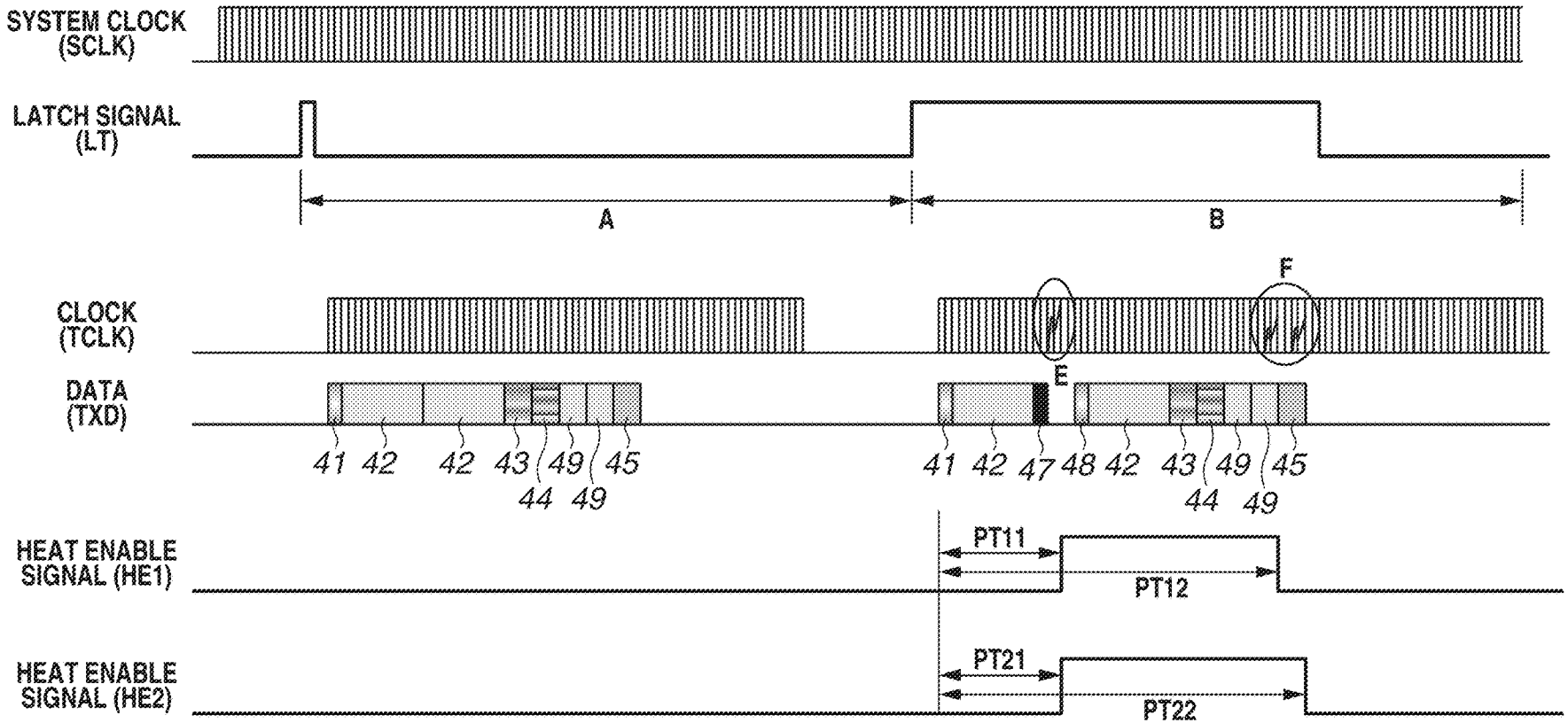
FIG. 13 is a timing chart illustrating a relationship between a command and a heat enable signal of the image recording apparatus in FIG. 12.

FIG. 13 is a timing chart illustrating a relationship between the recording data to which the series of commands is attached by the data transfer unit 301, and the heat enable signals HE1 and HE2. In FIG. 13, the system clock SCLK, the latch signal LT, the clock TCLK, the data TXD, and the heat enable signals HE1 and HE2 are illustrated in this order from the top.

In a section A, the data TXD signal to which the series of commands is attached is serially transferred in synchronization with the clock TCLK. First, a start command 41 is transferred. Subsequent to the start command 41, an image data transfer command 42 for the recording element array 601, an image data transfer command 42 for the recording element array 602, a sensor switching command 43, and a heater control command 44, are transferred in this order. Subsequent to the heater control command 44, a timing command 49 for the recording element array 601 and a timing command 49 for the recording element array 602 are transferred. Lastly, an error detection command 45 is transferred.

A section B includes two sections, i.e., sections E and F, in which the crosstalk noise is superimposed on the clock TCLK. In the section E, because the heat enable signals HE1 and HE2 rise at the same timing, the noise is at a level at which data corruption occurs. On the other hand, in the section F, because the heat enable signals HE1 and HE2 fall at different timings, the noise level at this time is low when compared to the section E. At this time, the measurement value of the number of discharges of each of the recording element arrays 601 and 602 is less than the threshold value. Therefore, the noise in the section F is not at a level at which data corruption occurs. Therefore, the stop command 47 and the restart command 48 are inserted to only the section E and not to the section F.

More specifically, the stop command 47 is transferred immediately before the section E. The restart command 48 is transferred immediately after the section E, i.e., when a predetermined time has passed after the stop command 47 is transferred. After the restart command 48 is transferred, the transfer command 42 for the recording element array 602, the sensor switching command 43, the heater control command 44, the timing command 49 for the recording element array 601, and the error detection command 45 are transferred in this order.

Next, a processing procedure for transferring recording data to which the series of commands is attached will be described in detail.

Figure 14A:
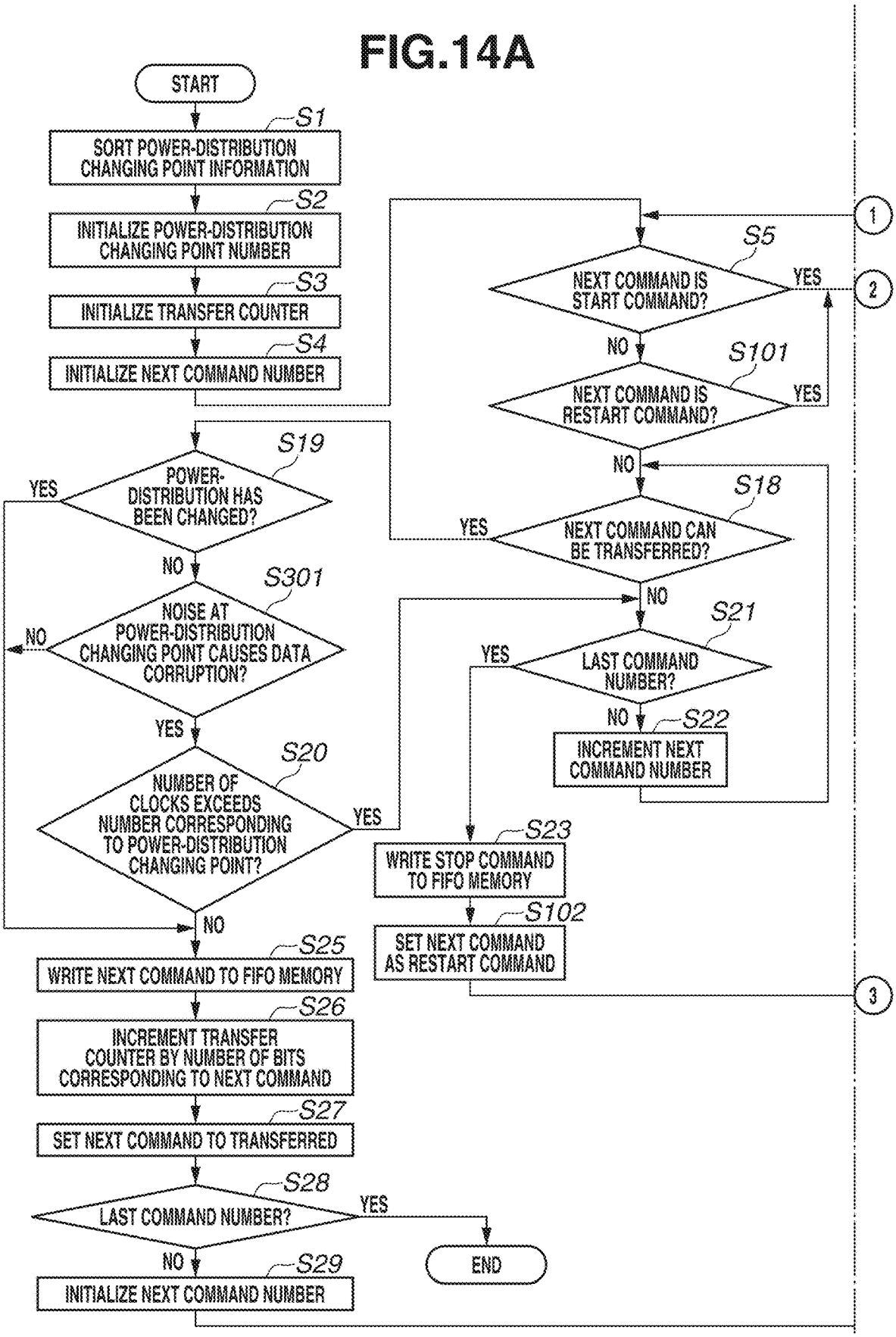
FIGS. 14A and 14B are a flowchart illustrating operation of a data array group generation unit of the image recording apparatus in FIG. 12.
Figure 14B:
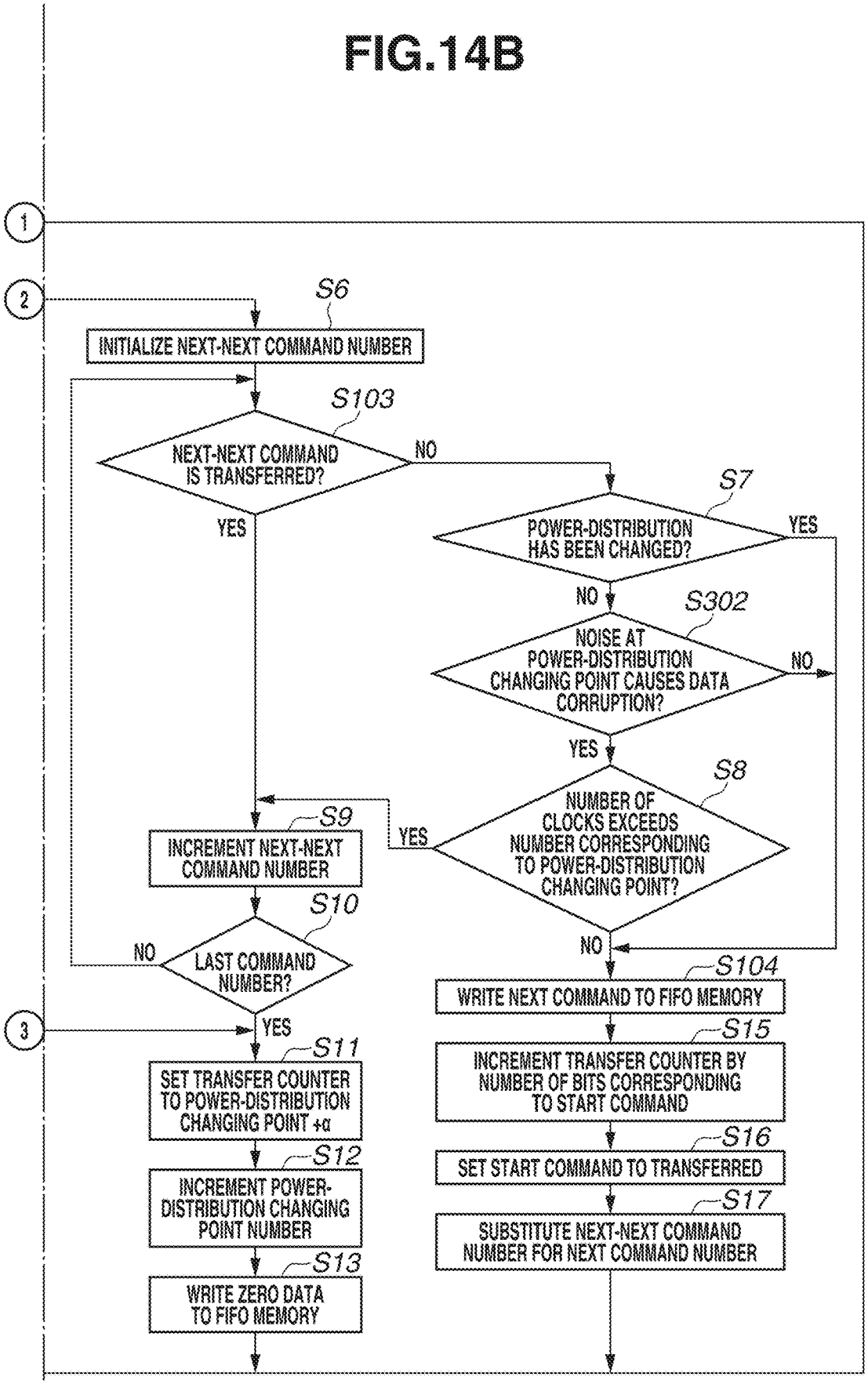

FIGS. 14A and 14B are a flowchart illustrating control flow for attaching a series of commands to recording data. The control flow in FIGS. 14A and 14B is executed each time the latch signal LT rises up to the high level. The control flow in FIGS. 14A and 14B is different from the control flow in FIGS. 7A and 7B in that steps S301 and S302 are added thereto. Detailed description of the processing steps similar to those of the control flow in FIGS. 7A and 7B will be omitted.

In step S19, the data array group generation unit 4003 determines whether power-distribution has been changed at the target power-distribution changing point. If the power-distribution has not been changed (NO in step S19), the processing proceeds to step S301. In step S301, the data array group generation unit 4003 determines whether the noise at the power-distribution changing point is at a level at which data corruption occurs. If the noise is at a level at which data corruption occurs (YES in step S301), the processing proceeds to step S20. If the noise is not at a level at which data corruption occurs (NO in step S301), the processing proceeds to step S25.

In step S7, the data array group generation unit 4003 determines whether power-distribution has been changed at all of the power-distribution changing points sorted in steps S1 and S2. If power-distribution has been changed at all of the power-distribution changing points (YES in step S7), the processing proceeds to step S104. If power-distribution has not been changed at all of the power-distribution changing points (NO in step S7), the processing proceeds to step S302. In step S302, the data array group generation unit 4003 determines whether the noise at the power-distribution changing point is at a level at which data corruption occurs. If the noise is at a level at which data corruption occurs (YES in step S302), the processing proceeds to step S8. If the noise is not at a level at which data corruption occurs (NO in step S302), the processing proceeds to step S104.

The effect similar to the effect achieved in the first to the third exemplary embodiments is achieved by the image processing apparatus of the present exemplary embodiment.

In addition, because the stop command is not transferred when the crosstalk noise does not have an influence on the data transfer clock and the data, a stop period of recording data transfer can be reduced when compared to the first to the third exemplary embodiments.

The disclosure is not limited to the configurations described in the first to the fourth exemplary embodiments. The configurations described in the first to the fourth exemplary embodiments are merely examples, and can be changed as appropriate.

For example, in the image recording apparatus according to each of the exemplary embodiments, the data transfer unit may encode the recording data to which the series of commands is attached by a predetermined unit. Further, the data transfer unit may generate a data array in which data corresponding to the clock is embedded in the encoded data and serially transfer the data array in synchronization with the clock. In this case, the recording head receives the data array transferred from the data transfer unit through the reception circuit. The recording head includes a clock recovery circuit for recovering the clock from the data array received from the data transfer unit and a decoding circuit for recovering the data array and decodes the recovered data array to original data in synchronization with the clock recovered by the clock recovery circuit.

Although the exemplary embodiments have been described by taking the image recording apparatus as an example, the disclosure is not limited to the image recording apparatus. The aspect of the embodiments is applicable to an apparatus that transmits or receives data in synchronization with a clock, in which the clock and data are influenced by the crosstalk noise generated when elements are turned on.

According to the aspect of the embodiments, it is possible to suppress an influence of the crosstalk noise on the recording data without stopping the clock used for transferring the recording data.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-054533, filed Mar. 22, 2019, which is hereby incorporated by reference herein in its entirety.

What is claimed is:

1. An apparatus comprising:

a first acquisition unit configured to acquire recording data for executing recording on a recording medium;

a transfer unit configured to attach a series of commands to the recording data and transfer the recording data to which the series of commands is attached to a recording head having a plurality of recording elements for executing recording on the recording medium in synchronization with a clock; and a second acquisition unit configured to acquire power-distribution timing to the plurality of recording elements, wherein the series of commands includes a stop command for temporarily stopping transfer of the recording data for a predetermined period corresponding to the power-distribution timing, which is generated based on the acquired power-distribution timing.

2. The apparatus according to claim 1, wherein the stop command includes a momentary stop code representing that data transfer is brought into a stopped state temporarily, data specifying the predetermined period, and dummy data to be transferred during the predetermined period.

3. The apparatus according to claim 1, wherein the transfer unit includes a latch circuit configured to latch timing data representing timings for starting and ending power-distribution of the recording elements, an attaching unit configured to attach the stop command, and a generation unit configured to generate a data array group to be transmitted by the series of commands and selectively insert the attached stop command to the data array group based on the latched timing data.

4. The apparatus according to claim 3, wherein the generation unit inserts the stop command immediately before the power-distribution to the recording elements is started, or respectively inserts the stop commands immediately before the power-distribution to the recording elements is started and ended.

5. The apparatus according to claim 4, wherein the series of commands further includes a restart command for restarting the data transfer, and wherein the generation unit inserts the restart command immediately after the predetermined period by the stop command.

6. The apparatus according to claim 3, wherein the series of commands includes a timing command for transferring timing data representing timings of starting and ending power-distribution to the recording elements, and wherein the generation unit selectively inserts the timing command to the data array group.

7. The apparatus according to claim 1, wherein the transfer unit transfers the stop command in a case where a number of recording elements simultaneously turned on from among the plurality of recording elements is a threshold value or more.

8. The apparatus according to claim 1, wherein the plurality of recording elements constitutes a plurality of recording element arrays, and wherein the transfer unit compares a plurality of heat enable signals representing power-distribution timings of the recording elements generated for the respective recording element arrays, and transfers the stop command in a case where rising timings or falling timings of the heat enable signals match each other.

9. The apparatus according to claim 1, wherein the transfer unit transfers the recording data to which the series of commands is attached by using at least one data line and one clock line.

10. The apparatus according to claim 1, wherein the transfer unit encodes the recording data to which the series of commands is attached in predetermined units, generates a data array in which data corresponding to the clock is embedded in the encoded data, and serially transfers the data array in synchronization with the clock.

11. The apparatus according to claim 1, further comprising a recording head having a plurality of recording elements, configured to receive the recording data to which the series of commands is attached from the apparatus.

12. A recording head having a plurality of recording elements, comprising:

a reception circuit configured to receive recording data to which a series of commands is attached in synchronization with a clock;

a retaining circuit configured to retain the recording data;

a driving circuit configured to drive the recording elements based on a heat enable signal representing a power-distribution timing to the recording elements and the retained recording data; and an analysis unit configured to analyze the series of commands to control a retaining operation of the recording data with respect to the retaining circuit based on a result of the analysis, wherein the series of commands includes a stop command for temporarily stopping transfer of the recording data for a predetermined period in accordance with the power-distribution timing of the recording elements, and wherein, when the stop command is detected, the analysis unit stops the retaining operation of the recording data with respect to the retaining circuit for the predetermined period.

13. The recording head according to claim 12, wherein the reception circuit includes a clock recovery circuit configured to receive a data array in which data corresponding to the clock is embedded in encoded recording data to which the series of commands is attached and recover the clock from the data array, and a decoding circuit configured to recover the data array and decodes the recovered data array to original data in synchronization with the clock recovered by the clock recovery circuit.

14. A method comprising:

acquiring recording data for executing recording on a recording medium;

attaching a series of commands to the recording data, and transferring the recording data to which the series of commands is attached, to a recording head having a plurality of recording elements for executing recording on the recording medium in synchronization with a clock; and acquiring a power-distribution timing to each of the plurality of recording elements, wherein the series of commands includes a stop command for temporarily stopping transfer of the recording data for a predetermined period corresponding to the power-distribution timing, which is generated based on the acquired power-distribution timing.

15. The method according to claim 14, wherein the stop command includes a momentary stop code representing that data transfer is brought into a stopped state temporarily, data specifying the predetermined period, and dummy data to be transferred during the predetermined period.

16. The method according to claim 14, further comprising:

latching timing data representing timings for starting and ending power-distribution of the recording elements, an attaching unit configured to attach the stop command; and generating a data array group to be transmitted by the series of commands and selectively inserting the attached stop command to the data array group based on the latched timing data.

17. The method according to claim 14, wherein the transferring transfers the stop command in a case where a number of recording elements simultaneously turned on from among the plurality of recording elements is a threshold value or more.

18. The method according to claim 14, wherein the plurality of recording elements constitutes a plurality of recording element arrays, and wherein the transferring compares a plurality of heat enable signals representing power-distribution timings of the recording elements generated for the respective recording element arrays, and transfers the stop command in a case where rising timings or falling timings of the heat enable signals match each other.

19. The method according to claim 14, wherein the transferring transfers the recording data to which the series of commands is attached by using at least one data line and one clock line.

20. The method according to claim 14, wherein the transferring encodes the recording data to which the series of commands is attached in attaching, generates a data array in which data corresponding to the clock is embedded in the encoded data, and serially transfers the data array in synchronization with the clock.

* * * * *